US011108174B2

(12) United States Patent
Hayashi et al.

(10) Patent No.: US 11,108,174 B2
(45) Date of Patent: Aug. 31, 2021

(54) STACK-TYPE WIRE MOUNT WAFER CONNECTOR AND CONNECTOR ASSEMBLY

(71) Applicant: 3M INNOVATIVE PROPERTIES COMPANY, St. Paul, MN (US)

(72) Inventors: Tatsuya Hayashi, Sagamiharashi (JP); Masahito Naito, Sagamihara (JP)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 16/721,980

(22) Filed: Dec. 20, 2019

(65) Prior Publication Data

US 2020/0212607 A1 Jul. 2, 2020

(30) Foreign Application Priority Data

Dec. 26, 2018 (JP) ..... JP2018-242495

(51) Int. Cl.
*H01R 9/24* (2006.01)
*H01R 9/22* (2006.01)
*H01R 12/71* (2011.01)

(52) U.S. Cl.
CPC ..... *H01R 9/2408* (2013.01); *H01R 9/223* (2013.01); *H01R 12/716* (2013.01)

(58) Field of Classification Search
CPC . H01R 9/22; H01R 9/223; H01R 9/24; H01R 9/2408; H01R 9/2416; H01R 12/716; H01R 13/506; H01R 13/514; H01R 13/518
See application file for complete search history.

(56) References Cited

U.S. PATENT DOCUMENTS 4,491,381 A 1/1985 Hamsher, Jr. et al.
4,556,275 A * 12/1985 Hamsher, Jr. ..... H01R 23/6873 29/858
5,380,220 A 1/1995 Okabe
(Continued)

FOREIGN PATENT DOCUMENTS

JP H10-041040 2/1998
JP H10-074541 3/1998
(Continued)

*Primary Examiner* — Oscar C Jimenez
(74) *Attorney, Agent, or Firm* — Robert S. Moshrefzadeh

(57) ABSTRACT

To provide a stack-type wire mount wafer connector and a connector assembly that can reduce the number of components and the size, and can enhance operability of insertion and removal.

A latch portion 25 that is integrally formed with a wafer 40 and extends along a second side surface 46*a* of the wafer 40, at least one protrusion 47*b* extending outward along a Z-axis direction of the wafer 40 from a first base portion 47 of the wafer, and at least one opening portion into which the protrusion 47*b* of another stack-type wire mount wafer connector 20 is to be inserted are included. When the protrusion 47*b* of another stack-type wire mount wafer connector 20 is inserted into the opening portion of the stack-type wire mount wafer connector 20, shifting between the stack-type wire mount wafer connector 20 and another stack-type wire mount wafer connector 20 in a fitting direction (X-axis direction) of a fitting connector is prevented.

9 Claims, 11 Drawing Sheets

(56) References Cited

U.S. PATENT DOCUMENTS

| | | | | |
|---|---|---|---|---|
| 5,938,481 | A * | 8/1999 | Okabe | H01R 13/432<br>439/701 |
| 6,000,971 | A | 12/1999 | Hatagishi | |
| 8,936,474 | B2 | 1/2015 | Katsuse | |
| 9,502,158 | B2 * | 11/2016 | Bes | H01R 13/518 |
| 10,404,006 | B2 * | 9/2019 | Kawahara | H01R 13/514 |
| 10,673,173 | B2 * | 6/2020 | Kawahara | H01R 25/003 |
| 2020/0212624 | A1 * | 7/2020 | Kawahara | H01R 13/6272 |

FOREIGN PATENT DOCUMENTS

| | | |
|---|---|---|
| JP | H10-079273 | 3/1998 |
| JP | 2000-133336 | 5/2000 |
| JP | 2004-335218 | 11/2004 |
| JP | 2011-134571 | 7/2011 |

* cited by examiner

STACK-TYPE WIRE MOUNT WAFER CONNECTOR AND CONNECTOR ASSEMBLY

TECHNICAL FIELD

One aspect of the present disclosure relates to a stack-type wire mount wafer connector and a connector assembly.

BACKGROUND ART

A stack-type wire mount wafer connector and a connector assembly have hitherto been known. Patent Document 1 describes a multi-stage connector including a first housing, a second housing, and a cover. In the multi-stage connector, the first housing, the second housing, and the cover enter another box-like connector in a state in which the first housing, the second housing, and the cover are stacked on each other. The cover includes a lock piece to be engaged with the other connector, and the multi-stage connector is fitted into the other connector by engagement of the lock piece of the cover.

CITATION LIST

Patent Documents

[Patent Document 1] JP 10-79273 A

SUMMARY OF INVENTION

Technical Problem

Incidentally, regarding a stack-type wire mount wafer connector such as the multi-stage connector described above, enhancement in operability of insertion and removal has been demanded. However, the stack-type wire mount wafer connector includes a large number of components, and such a large number of components complicate the assembly in the present situation. In the multi-stage connector described above, the cover, instead of the first housing or the second housing, is engaged with the other connector, and thus the multi-stage connector cannot be fitted into the other connector unless the cover is mounted on the second housing. In the multi-stage connector described above, the first housing or the second housing alone cannot be inserted into or removed from the other connector, and the cover is always required to perform such insertion and removal. Also in this respect, operation of insertion and removal cannot be performed easily. In addition, not only is each of the first housing and the second housing alone unable to be inserted or removed, but the other connector also requires an area for accommodating the cover. Thus, the size of the connector assembly is large in the present situation.

An object of one aspect of the present disclosure is to provide a stack-type wire mount wafer connector and a connector assembly that can reduce the number of components and the size and can also enhance operability of insertion and removal.

Solution to Problem

A stack-type wire mount wafer connector according to one aspect of the present disclosure is a stack-type wire mount wafer connector for electrically connecting a plurality of wires to a fitting connector, and includes a wafer that is stackable and electrically insulated, the stack-type wire mount wafer connector including: a first base portion and a second base portion extending between a first side portion and a second side portion facing each other and extending between a first end portion and a second end portion facing each other, the first base portion and the second base portion defining cavities between the first base portion and the second base portion; a first end surface provided at the first end portion, the first end surface being configured to receive the plurality of wires; a second end surface provided at the second end portion, the second end surface being configured to be fitted to the fitting connector; a first side surface provided at the first side portion; a second side surface provided at the second side portion; a latch portion that is integrally formed with the wafer and extends along the second side surface of the wafer; at least one protrusion extending outward along a thickness direction (Z-axis) of the wafer from the first base portion of the wafer; and at least one opening portion into which at least one protrusion of another stack-type wire mount wafer connector is to be inserted; wherein, when the at least one protrusion of the another stack-type wire mount wafer connector is inserted into the at least one opening portion of the stack-type wire mount wafer connector, slippage between the stack-type wire mount wafer connector and the another stack-type wire mount wafer connector in a fitting direction (X-axis) of the fitting connector is prevented.

A connector assembly according to one aspect of the present disclosure includes a first connector including an open end portion and defining a receiving area, and a plurality of stackable second connectors, wherein: each of the plurality of second connectors is inserted into the receiving area through the open end portion and is fitted into the first connector; each of the plurality of second connectors includes a latch portion configured to change its state between a latched and engaged state in which each of the plurality of second connectors is latched on and engaged with the first connector, and an unlatched state in which each of the plurality of second connectors is unlatched from the first connector; and when the latch portion of each of the plurality of stacked second connectors is not in the unlatched state, none of the plurality of stacked second connectors is unfitted from the first connector.

Advantageous Effects of Invention

According to one aspect of the present disclosure, the number of components and the size can be reduced, and operability of insertion and removal can be enhanced as well.

DESCRIPTION OF EMBODIMENTS

An embodiment of a stack-type wire mount wafer connector and a connector assembly according to the present disclosure will be described below with reference to the drawings. In the description of the drawings, the same or equivalent elements are denoted by the same reference signs, and overlapping description will be omitted, as appropriate.

Figure 1:
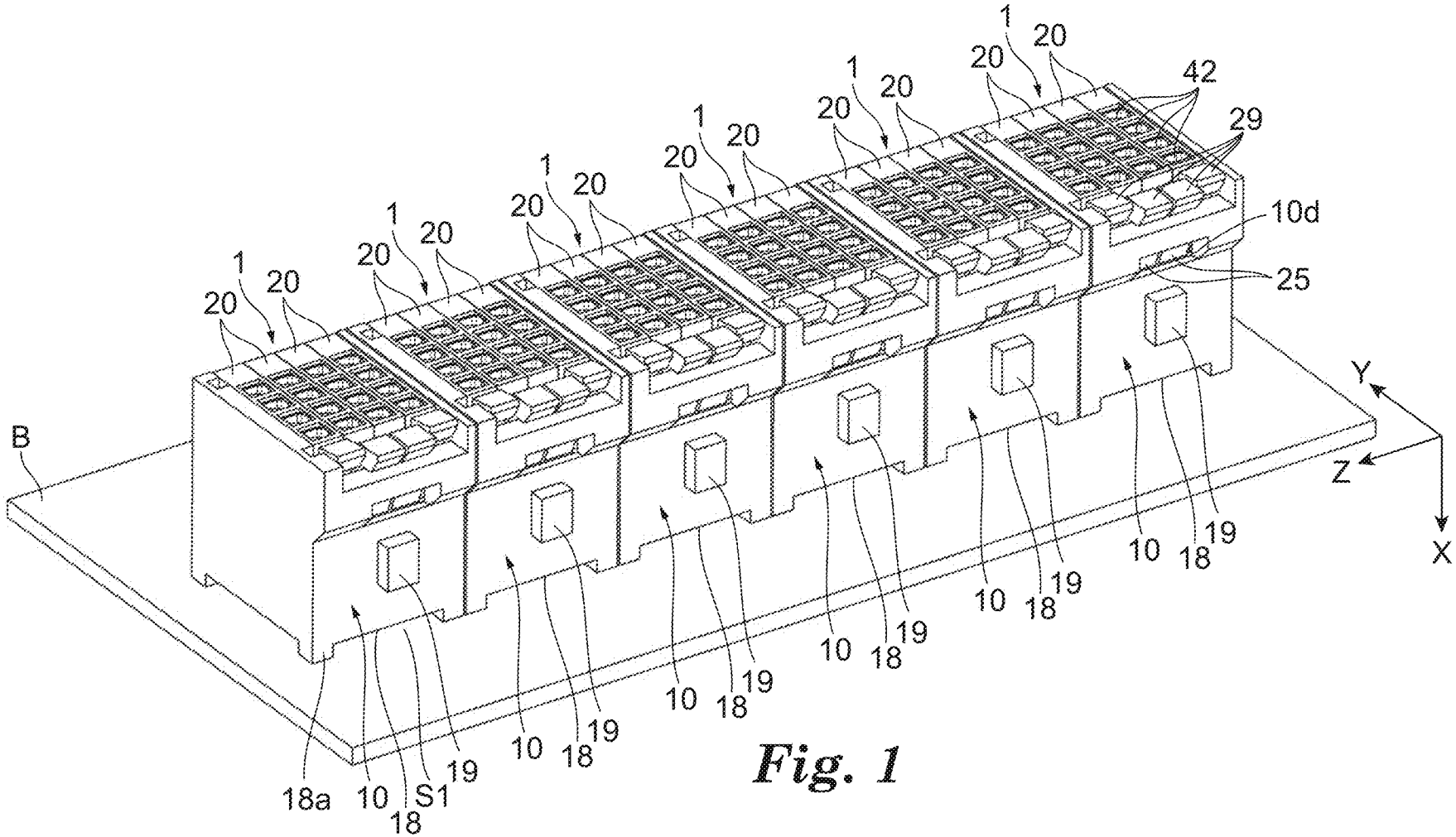
FIG. 1 is a perspective view illustrating an example of a state in which a plurality of connector assemblies according to an embodiment are arrayed on a board.

With reference to FIG. 1, a connector assembly 1 according to the present embodiment will be described. As illustrated in FIG. 1, for example, connector assemblies 1 are disposed on a board B, and a plurality of connector assemblies 1 are disposed on the board B to be aligned in one direction. Note that the plurality of connector assemblies 1 may be disposed to be aligned in a lattice-like shape, for example, and a manner of disposition of the connector assemblies 1 can be changed, as appropriate. Each connector assembly 1 includes a fitting connector 10 serving as a first connector to be mounted on the board B, and stack-type wire mount wafer connectors 20 serving as a plurality of second connectors to be accommodated in the fitting connector 10. For example, the fitting connector 10 is a board-mounted connector (board mount connector) to be mounted on the board B.

For example, the fitting connector 10 is formed into a box-like shape, and a plurality of stack-type wire mount wafer connectors 20 can be fitted into (inserted into and removed from) the inside of the box-like fitting connector 10. As an example, the fitting connector 10 is formed into a bottomed box-like shape having a bottom portion 18. For example, each stack-type wire mount wafer connector 20 is formed into a plate-like shape, and the plurality of stack-type wire mount wafer connectors 20 is fitted into the fitting connector 10 in a state in which the plurality of stack-type wire mount wafer connectors 20 is stacked in a thickness direction of the stack-type wire mount wafer connector 20.

Note that, in the following description, a fitting direction of the stack-type wire mount wafer connector 20 into the fitting connector 10 may be referred to as an extending direction of an X-axis (X-axis direction), a direction in which the plurality of stack-type wire mount wafer connectors 20 is aligned in the fitting connector 10 may be referred to as an extending direction of a Z-axis (Z-axis direction), and a horizontal direction intersecting (for example, being orthogonal to) both the X-axis and the Z-axis may be referred to as an extending direction of a Y-axis (Y-axis direction). A direction of the connector assembly 1 as seen from the board B may be referred to as an upward direction, and a direction of the board B as seen from the connector assembly 1 may be referred to as a downward direction.

For example, the X-axis direction corresponds to a thickness direction of the board B and also to a direction in which the board B and the connector assemblies 1 are arranged in parallel. For example, the Y-axis direction corresponds to a direction in which channels 42 (described later) of each stack-type wire mount wafer connector 20 are aligned. For example, the Z-axis direction corresponds to a direction in which a plurality of fitting connectors 10 is aligned and also to a direction in which the plurality of stack-type wire mount wafer connectors 20 is stacked.

Figure 2:
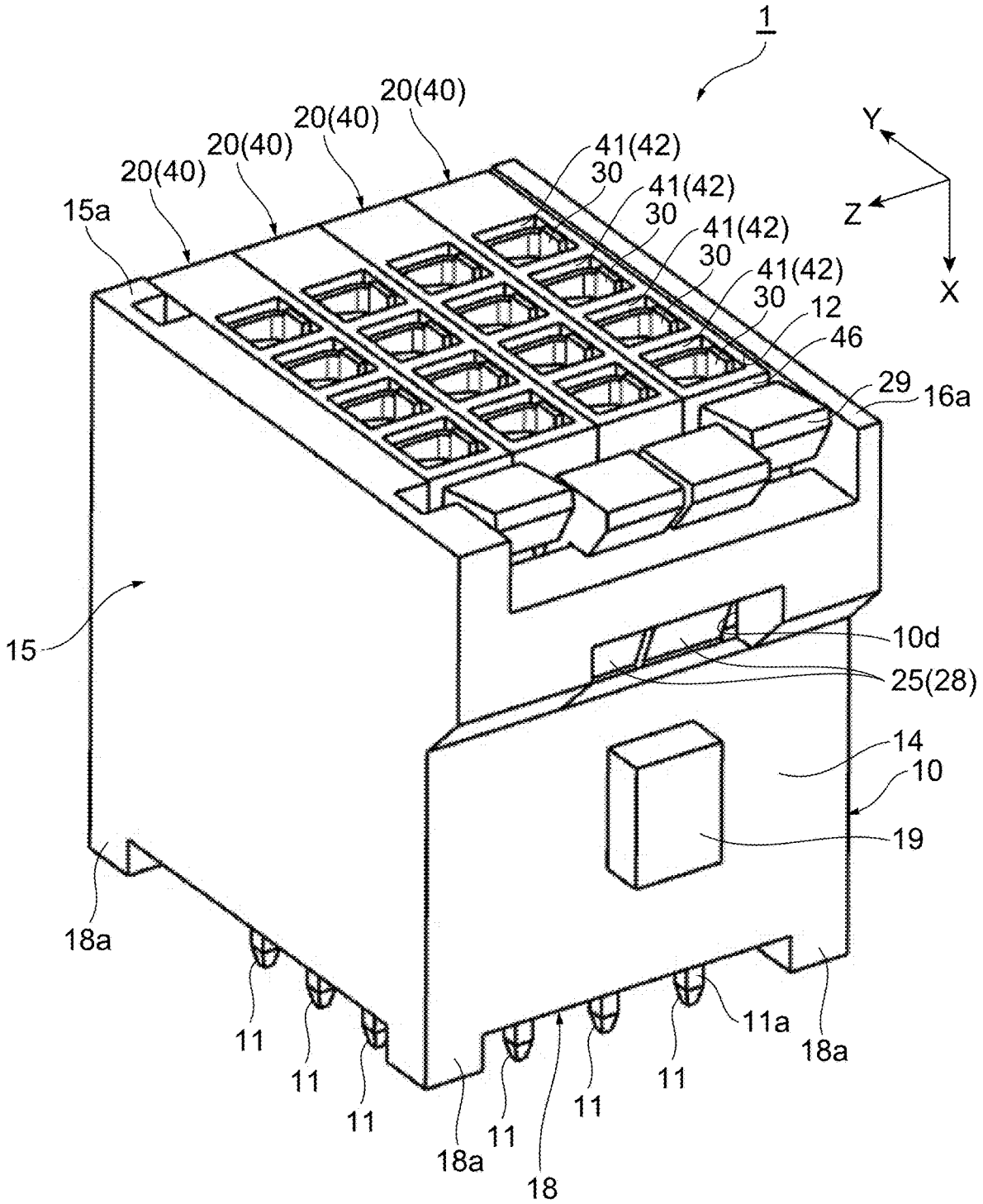
FIG. 2 is a perspective view illustrating the connector assembly according to the embodiment.
Figure 3:
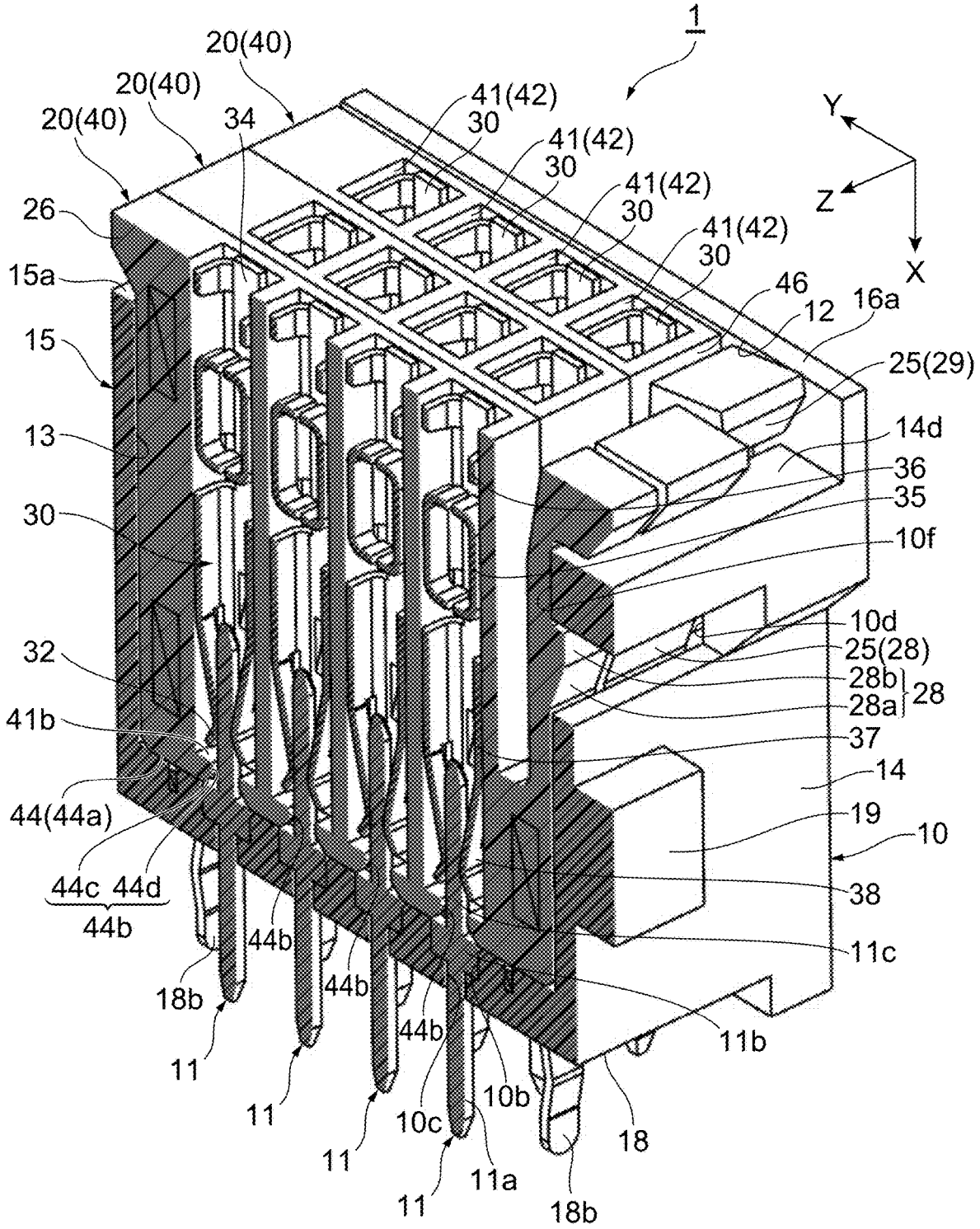
FIG. 3 is a vertical cross-sectional view of the connector assembly of FIG. 2.

FIG. 2 is a perspective view illustrating the connector assembly 1. FIG. 3 is a cross-sectional view of the connector assembly 1, which is a cross-section of the connector assembly 1 taken along a plane extending in both the X-axis and the Y-axis (XY-plane). As illustrated in FIG. 2 and FIG. 3, the plurality of stack-type wire mount wafer connectors 20 is disposed in the Z-axis inside the fitting connector 10, and each stack-type wire mount wafer connector 20 includes a plurality of terminals 30, and an electrically insulated wafer 40 having cavities 41 in which the plurality of terminals 30 is to be accommodated. The cavities 41 are divided by a plurality of channels 42.

For example, a plurality of contacts 11 to be inserted into the board B extends and projects from the fitting connector 10, and each contact 11 is formed into a rod-like shape extending in the X-axis direction. Each contact 11 extends in the X-axis direction inside the cavity 41 of the wafer 40. As an example, the contact 11 includes a rod-like insertion portion 11*a* to be inserted into the board B, an extended portion 11*b* that is extended from the insertion portion 11*a* at an end portion of the insertion portion 11*a*, and a rod-like terminal connection portion 11*c* that extends from the extended portion 11*b* to the side opposite to the insertion portion 11*a* and is to be fitted into the terminal 30.

The fitting connector 10 includes a recessed portion 10*b* that is recessed downward (toward the board B side) at a bottom surface of the bottom portion 18 of the fitting connector 10 and into which the extended portion 11*b* of the contact 11 is to be fitted, and a hole portion 10*c* through which the insertion portion 11*a* of the contact 11 passes along the X-axis. The contact 11 is fixed to the fitting connector 10 in a state in which the insertion portion 11*a* is inserted through the hole portion 10*c* and the extended portion 11*b* is fitted into the recessed portion 10*b*.

The fitting connector 10 includes an open end portion 12, and a receiving area 13 that receives the stack-type wire mount wafer connectors 20. The fitting connector 10 defines the receiving area 13 that receives the plurality of stack-type wire mount wafer connectors 20. For example, the receiving area 13 is an area inside the box-like fitting connector 10, and the open end portion 12 is a portion that is opened on the side opposite to the bottom portion 18 (board B). In the receiving area 13, for example, the plurality of stack-type wire mount wafer connectors 20 is fitted into the fitting connector 10 along the X-axis, and the terminals 30 inside the stack-type wire mount wafer connectors 20 are thereby connected to (come in contact with) the contacts 11 that extend and project from the fitting connector 10.

For example, four stack-type wire mount wafer connectors 20 are fitted into the fitting connector 10. Each of the plurality of stack-type wire mount wafer connectors 20 includes a latch portion 25 to be engaged with the fitting connector 10. The fitting connector 10 includes a hole portion 10*d* with which the latch portion 25 is to be engaged. When the latch portion 25 is engaged with the hole portion 10*d*, the stack-type wire mount wafer connector 20 is fitted into the fitting connector 10.

For example, the hole portion 10*d* of the fitting connector 10 extends in the Y direction, in an area including the Z-axis direction center of the fitting connector 10. The latch portions 25 of some of the stack-type wire mount wafer connectors 20 out of the plurality of stack-type wire mount wafer connectors 20 aligning in the Z-axis direction are engaged with the fitting connector 10, while the latch portions 25 of the rest of the stack-type wire mount wafer connectors 20 are not engaged with the fitting connector 10.

For example, the latch portions 25 of the stack-type wire mount wafer connectors 20 located on the Z-axis direction center side out of the plurality of stack-type wire mount wafer connectors 20 aligning in the Z-axis direction are engaged with the fitting connector 10, while the latch portions 25 of the stack-type wire mount wafer connectors 20 located on both Z-axis direction end sides are not engaged with the fitting connector 10. As an example, the latch portions 25 of two stack-type wire mount wafer connectors 20 located on the Z-axis direction center side in the out of four stack-type wire mount wafer connectors 20 aligning in the Z-axis direction are engaged with the fitting connector 10, while the latch portions 25 of two stack-type wire mount wafer connectors 20 located on the side of Z-axis direction end portions are not engaged with the fitting connector 10.

Figure 4:
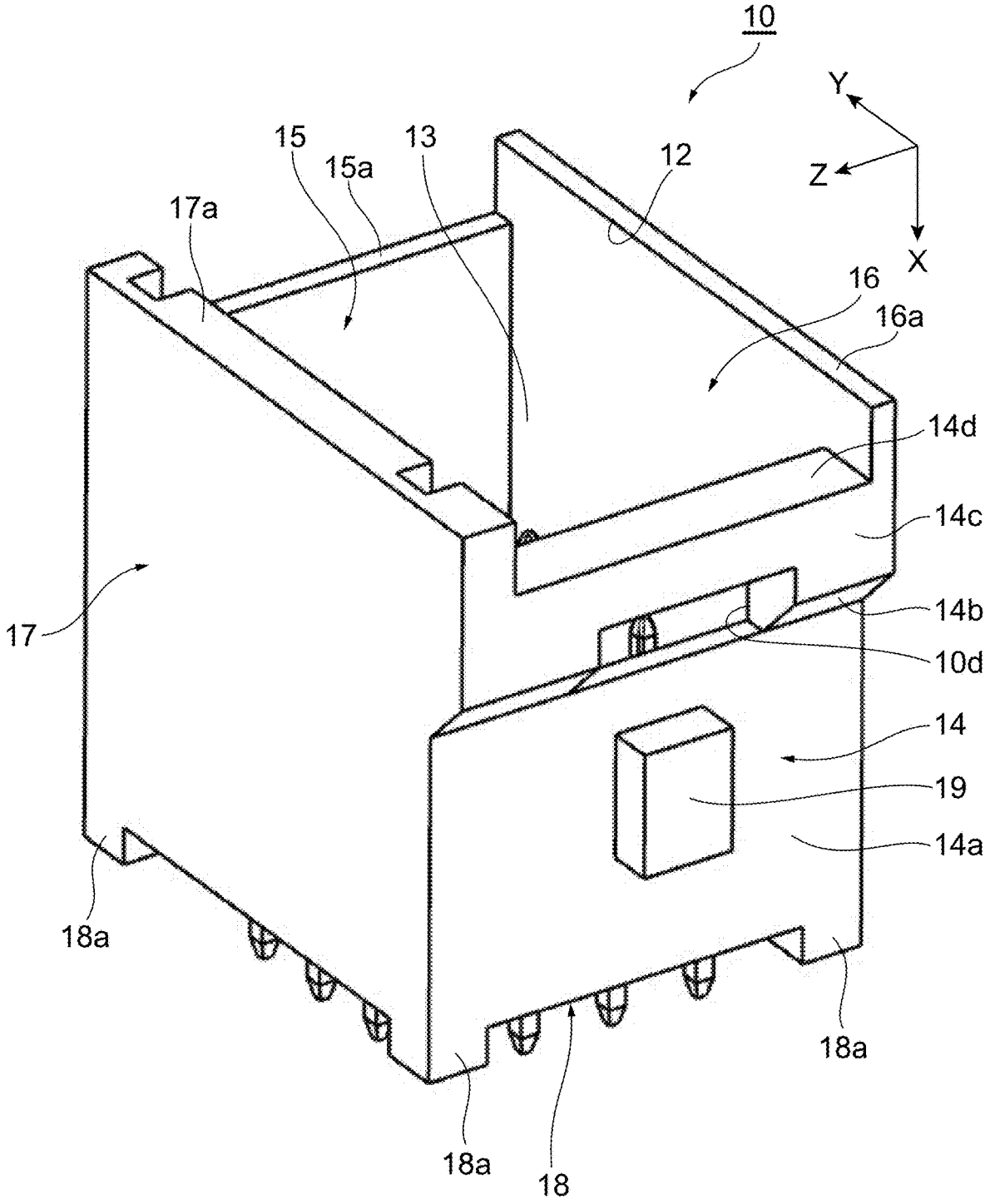
FIG. 4 is a perspective view illustrating an example of a first connector of the connector assembly of FIG. 2.

FIG. 4 is a perspective view illustrating the fitting connector 10. As illustrated in FIG. 4, the fitting connector 10 includes a pair of a first side portion 14 and a second side portion 15 that aligns in the Y-axis direction, and a pair of a third side portion 16 and a fourth side portion 17 that aligns in the Z-axis direction. The bottom portion 18, the first side portion 14, the second side portion 15, the third side portion 16, and the fourth side portion 17 of the fitting connector 10 described above define the receiving area 13, and the open end portion 12 is provided on the side opposite to the bottom portion 18.

For example, the bottom portion 18 includes a plurality of projecting portions 18*a* projecting toward the X-axis direction outer side of the bottom portion 18 (downward, toward the board B side), and board insertion portions 18*b* (see FIG. 3). For example, the board insertion portions 18*b* are metal portions, which are different from a resin portion of the fitting connector 10 (as an example, a portion other than the board insertion portions 18*b*). For example, the bottom portion 18 is formed into a rectangular shape, and the projecting portion 18*a* is provided at each of four corners of the bottom portion 18. For example, each of the plurality of projecting portions 18*a* comes in contact with an upper surface of the board B, and a space S1 (see FIG. 1) is formed between a portion of the bottom portion 18 except the projecting portions 18*a* and the upper surface of the board B. For example, the bottom portion 18 includes a pair of board insertion portions 18*b* aligning in the Y-axis direction. When each board insertion portion 18*b* is inserted into the board B, the fitting connector 10 is fixed to the board B.

The first side portion 14 includes a first outer surface 14*a* extending in both the X-axis direction and the Z-axis direction, an inclined surface 14*b* inclined from an end portion of the first outer surface 14*a* on the side opposite to the bottom portion 18 toward the Y-axis direction outer side, and a second outer surface 14*c* extending in both the X-axis direction and the Z-axis direction at an end portion of the inclined surface 14*b* on the side opposite to the first outer surface 14*a*. For example, each of the first outer surface 14*a*, the inclined surface 14*b*, and the second outer surface 14*c* is formed into a flat shape.

The first outer surface 14*a* is provided with a projecting portion 19 projecting toward the outer side of the fitting connector 10 (toward the Y-axis direction outer side). For example, the projecting portion 19 projects in a shape of a rectangle, in an area including the center of the first outer surface 14*a*. The projecting portion 19 is provided below the hole portion 10*d* (latch portion 25) of the fitting connector 10. The projecting portion 19 serves as a reference point when a fitting position of the stack-type wire mount wafer connectors 20 fitted into the fitting connector 10 is searched for with a finger.

The hole portion 10*d* described above is formed in the inclined surface 14*b* and the second outer surface 14*c*, and the hole portion 10*d* extends in the Y-axis direction. For example, the hole portion 10*d* is formed in an area including the Z-axis direction centers of the inclined surface 14*b* and a lower portion of the second outer surface 14*c*. A recessed portion 14*d* recessed downward from an upper end of the second outer surface 14*c* is formed in an upper portion of the second outer surface 14*c*, and the recessed portion 14*d* is formed in an area including the Z-axis direction center of the second outer surface 14*c*. Portions (upper portions) of the plurality of latch portions 25 are exposed from the recessed portion 14*d*. Portions of the plurality of latch portions 25 that are exposed from the recessed portion 14*d* can contribute to reducing the height of the stack-type wire mount wafer connectors 20 accommodated in the fitting connector 10, and can make it easier to pick up each latch portion 25 with a finger or the like.

For example, each of the second side portion 15, the third side portion 16, and the fourth side portion 17 is formed into a flat plate-like shape. The height of an upper end 15*a* of the second side portion 15 is lower than that of an upper end 16*a* of the third side portion 16 and an upper end 17*a* of the fourth side portion 17. For example, the height of the upper end 15*a* of the second side portion 15 may be substantially the same as the height of an upper surface (bottom surface) of the recessed portion 14*d*. Projecting portions 26 (described later) of the stack-type wire mount wafer connectors 20 are exposed from the upper end 15*a* of the second side portion 15.

Figure 5:
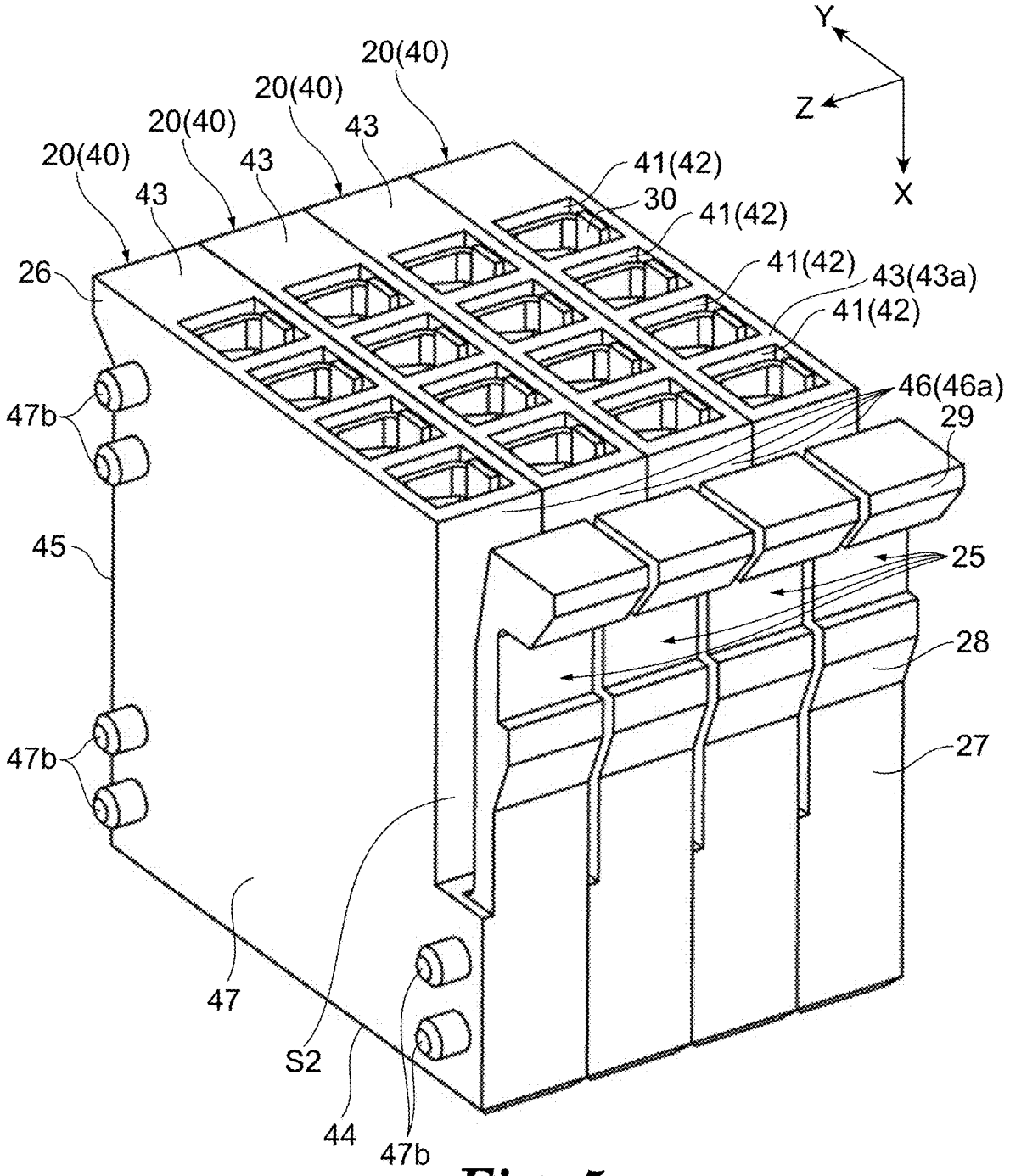
FIG. 5 is a perspective view illustrating an example of a plurality of second connectors of the connector assembly of FIG. 2.
Figure 6:
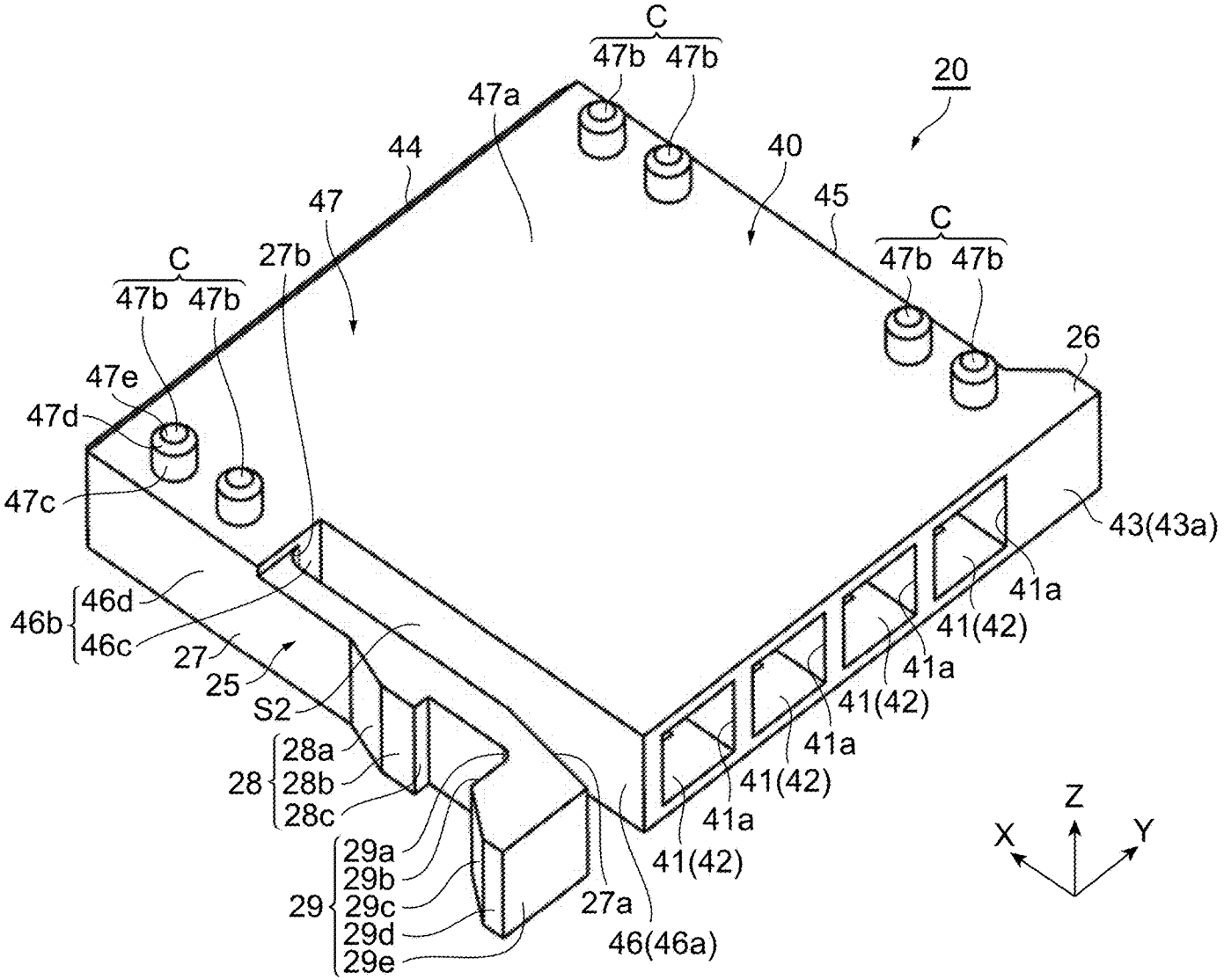
FIG. 6 is a perspective view illustrating an example of a wafer of the second connector of FIG. 5.
Figure 7:
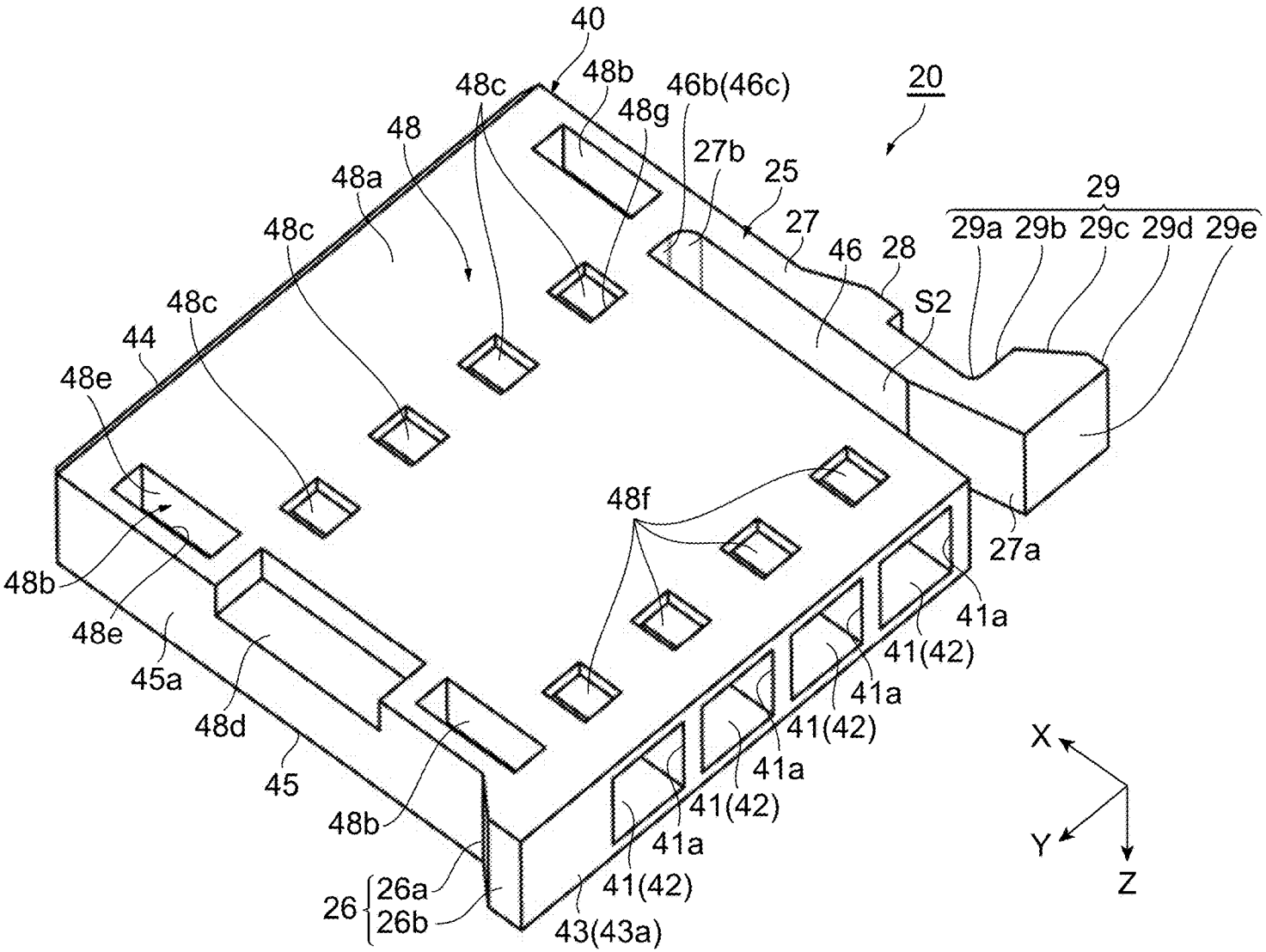
FIG. 7 is a perspective view of the wafer of FIG. 6, as seen in a direction different from that of FIG. 6.

FIG. 5 is a perspective view illustrating a plurality of stacked stack-type wire mount wafer connectors 20. FIG. 6 is a perspective view of the stack-type wire mount wafer connector 20. FIG. 7 is a perspective view of the stack-type wire mount wafer connector 20 of FIG. 6, as seen in a direction different from that of FIG. 6. As illustrated in FIG. 5, FIG. 6 and FIG. 7, for example, the plurality of stack-type wire mount wafer connectors 20, each of which is formed into a plate-like shape, is stacked in the Z-axis direction.

As described above, each stack-type wire mount wafer connector 20 includes the terminals 30 and the electrically insulated wafer 40. In FIG. 6 and FIG. 7, illustration of the terminals 30 is omitted. For example, the wafer 40 is formed into a plate-like shape extending in the X-axis direction and the Y-axis direction, and having its thickness in the Z-axis direction. The wafer 40 of the stack-type wire mount wafer connector 20 includes a first end portion 43 and a second end portion 44 that align in the X-axis direction, a first side portion 45 and a second side portion 46 that align in the Y-axis direction, and a first base portion 47 and a second base portion 48 that align in the Z-axis direction.

The first end portion 43 and the second end portion 44 face each other, and the first base portion 47 and the second base portion 48 extend between the first end portion 43 and the second end portion 44. The first side portion 45 and the second side portion 46 face each other, and the first base portion 47 and the second base portion 48 extend between the first side portion 45 and the second side portion 46. The cavities 41 described above are defined between the first base portion 47 and the second base portion 48.

The first end portion 43 includes a first end surface 43*a* for receiving a plurality of wires 50 (described later). For example, the first end surface 43*a* is formed into a rectangular shape facing the X-axis direction and extending to be elongated in the Y-axis direction. In other words, the first end surface 43*a* is formed into a rectangular shape including long sides extending in the Y-axis direction and short sides extending in the Z-axis direction. As an example, the first end surface 43*a* is formed into a planar shape. For example, openings 41*a* of the plurality of cavities 41 aligning in the Y-axis direction are formed in the first end surface 43*a*. As an example, each opening 41*a* is formed into a rectangular shape. For example, the second end portion 44 is located on the side opposite to the first end portion 43 as seen from the first base portion 47, and includes a second end surface 44*a* (see FIG. 3) that receives the plurality of contacts 11 extending from the fitting connector 10. For example, as with the first end surface 43*a*, the second end surface 44*a* is formed into a rectangular shape facing the X-axis direction and extending to be elongated in the Y-axis direction.

As illustrated in FIG. 3, for example, a plurality of hole portions 44*b* aligning in the Y-axis direction is formed in the second end surface 44*a* of the second end portion 44, and each hole portion 44*b* extends in the X-axis direction in the second end portion 44 and communicates with the corresponding cavity 41. The hole portion 44*b* is defined by a tapered surface 44*c* extending upward at an angle from the second end surface 44*a*, and an inner side surface 44*d* extending upward from upper ends of the tapered surfaces 44*c*. A bottom surface 41*b* of the cavity 41 is provided on an upper end of the inner side surface 44*d*, and a fitting portion 32 (described later) of the terminal 30 faces the bottom surface 41*b* of the cavity 41 in the X-axis direction. An upper surface of the extended portion 11*b* of the contact 11 faces the tapered surface 44*c*, and the terminal connection portion 11*c* extending and projecting upward from the extended portion 11*b* faces the inner side surface 44*d*.

As illustrated in FIG. 5, FIG. 6, and FIG. 7, the first side portion 45 includes a first side surface 45*a* facing the Y-axis direction, and a projecting portion 26 projecting in the Y-axis direction at one end of the first side surface 45*a* on the first end portion 43 side. For example, the first side surface 45*a* is formed into a rectangular shape extending to be elongated in the X-axis direction, and is formed into a flat shape extending in both the X-axis direction and the Z-axis direction. The projecting portion 26 includes an inclined surface 26*a* extending at an angle with respect to both the X-axis direction and the Y-axis direction from the first side surface 45*a*, and a top surface 26*b* located at the inclined surface 26*a* on the side opposite to the first side surface 45*a*.

For example, the second side portion 46 includes a second side surface 46*a* extending in the X-axis direction from the first end portion 43, a projecting portion 46*b* projecting in the Y-axis direction from an end portion of the second side surface 46*a* on the side opposite to the first end portion 43, and the latch portion 25 extending along the second side surface 46*a* from the projecting portion 46*b*. The latch portion 25 is integrally formed with the wafer 40. For example, the second side surface 46*a* is formed into a rectangular shape including long sides extending in the X-axis direction, and short sides extending in the Z-axis direction.

The projecting portion 46*b* includes a side surface 46*c* extending in the Y-axis direction and the Z-axis direction from the second side surface 46*a*, and a top surface 46*d* extending in the X-axis direction and the Z-axis direction at an end portion of the side surface 46*c* on the side opposite to the second side surface 46*a*. The latch portion 25 includes a plate-like base portion 27 continuing with the top surface 46*d*, an engaging portion 28 projecting from the base portion 27 toward the Y-axis direction outer side, and a pressed portion 29 that projects from a tip end of the base portion 27 toward the Y-axis direction outer side and is to be pressed in the Y-axis direction with a finger or the like.

The base portion 27 extends and projects from the side surface 46*c* of the projecting portion 46*b* toward the first end portion 43. An inclined surface 27*a* inclined with respect to both the X-axis direction and the Y-axis direction is formed at a tip end of the base portion 27 on the side opposite to the pressed portion 29. For example, a curved surface 27*b* connecting the base portion 27 and the side surface 46*c* to each other is formed between the base portion 27 and the side surface 46*c*. A space S2 is formed between the second side surface 46*a* and the base portion 27. The pressed portion 29 is a portion to be pressed toward the second side surface 46*a*. When the pressed portion 29 is pressed, the base portion 27 bends in the Y-axis direction with the side surface 46*c* serving as a base point. This bending of the base portion 27 in the Y-axis direction causes the engaging portion 28 to be engaged and disengaged. Details of engagement and disengagement of the engaging portion 28 will be described later.

The engaging portion 28 is provided between the side surface 46*c* (a base end of the base portion 27) and the pressed portion 29 (a tip end of the base portion 27). The engaging portion 28 includes a tapered surface 28*a* inclined with respect to both the X-axis direction and the Y-axis direction from the base portion 27, a top surface 28*b* extending in the X-axis direction and the Z-axis direction at an end portion of the tapered surface 28*a* on the Y-axis direction outer side, and a side surface 28*c* extending in the Y-axis direction and the Z-axis direction at the top surface 28*b* on the side opposite to the tapered surface 28*a*. The tapered surface 28*a* is a portion to face an inner surface 10*f* of the hole portion 10*d* (see FIG. 3), and the top surface 28*b* and the side surface 28*c* are portions to be engaged with the hole portion 10*d*.

The pressed portion 29 includes a curved surface 29*a* extending from the base portion 27, a first projecting surface 29*b* extending from the curved surface 29*a*, an inclined surface 29*c* extending from the first projecting surface 29*b*, a top surface 29*d*, and a second projecting surface 29*e* extending from the top surface 29*d* on the side opposite to the inclined surface 29*c*. The curved surface 29*a* is inclined with respect to both the X-axis direction and the Y-axis direction from the base portion 27. The first projecting surface 29*b* extends in the Y-axis direction and the Z-axis direction from the curved surface 29*a* on the side opposite to the base portion 27, and the inclined surface 29*c* is inclined with respect to both the X-axis direction and the Y-axis direction from an end portion of the first projecting surface 29*b* on the side opposite to the curved surface 29*a*.

The top surface 29*d* is located at the inclined surface 29*c* on the side opposite to the first projecting surface 29*b*, and the second projecting surface 29*e* extends in the Y-axis direction and the Z-axis direction at the top surface 29*d* on the side opposite to the inclined surface 29*c*. The top surface 29*d* is a portion where a finger or the like comes in contact. When the top surface 29*d* is pressed with a finger or the like, the base portion 27 bends toward the Y-axis direction center side of the stack-type wire mount wafer connector 20.

For example, the first base portion 47 includes a surface 47*a* facing another stack-type wire mount wafer connector 20 (wafer 40) in the Z-axis direction, and protrusions 47*b* extending from the surface 47*a* toward a thickness direction outer side of the wafer 40 (in the Z-axis). For example, the surface 47*a* is formed into a flat shape, and each protrusion 47*b* is formed into a cylindrical shape. Note that the shape of the protrusion 47*b* is not limited to a cylindrical shape. For example, the shape of the protrusion 47*b* may be a prism-like shape, an elongated cylindrical shape, or the like, and can be changed, as appropriate.

The protrusion 47*b* is a portion to couple a wafer 40 of another stack-type wire mount wafer connector 20 to the wafer 40. For example, the first base portion 47 includes a plurality of protrusions 47*b*. The plurality of protrusions 47*b* is disposed at one Y-axis direction end of the first base portion 47, and anther Y-axis direction end of the first base portion 47. With the protrusions 47*b* being disposed at the one Y-axis direction end of the first base portion 47 and the other Y-axis direction end of the first base portion 47, as described above, another stack-type wire mount wafer connector 20 can be firmly coupled at both the Y-axis direction end portions.

For example, in at least one of Y-axis direction end portions (as an example, an end portion on the projecting portion 26 side), the plurality of protrusions 47*b* is disposed at one X-axis direction end and another X-axis direction end. With the protrusions 47*b* being disposed at the one X-axis direction end and the other X-axis direction end, another stack-type wire mount wafer connector 20 can be firmly coupled at both the X-axis direction end portions. In the present embodiment, in an end portion on the projecting portion 26 side in the Y-axis direction (side opposite to the latch portion 25), a pair C of two protrusions 47*b* is disposed at each X-axis direction end portion. In an end portion on the latch portion 25 side in the Y-axis direction, a pair C of two protrusions 47*b* is disposed at an X-axis direction end portion on the second end portion 44 side. In each pair C, two protrusions 47*b* are disposed to be aligned in the X-axis direction. Each protrusion 47*b* includes an outer peripheral surface 47*c* extending upward with respect to the surface 47*a*, an inclined surface 47*d* inclined in such a direction that the diameter of the protrusion 47*b* is reduced from an upper end of the outer peripheral surface 47*c*, and a top surface 47*e* extending at the upper end of the inclined surface 47*d* so as to be substantially in parallel with the surface 47*a*.

For example, the second base portion 48 includes a surface 48*a* facing another stack-type wire mount wafer connector 20 (wafer 40) in the Z-axis direction, opening portions 48*b* recessed from the surface 48*a* in the thickness direction of the wafer 40 and into which the protrusions 47*b* described above are to be inserted, and engaged portions 48*c* and 48*f* with which the terminals 30 passing through the cavities 41 are to be engaged. For example, the engaged portion 48*c* is a through hole with which the terminal 30 is to be engaged when a wire connecting portion 31 is located inside the wafer 40. For example, the engaged portion 48*f* is a through hole with which the terminal 30 is to be engaged when a portion of the wire connecting portion 31 is located outside the wafer 40. For example, the engaged portions 48*c* and 48*f* are through holes extending through the second base portion 48 in the Z-axis direction. As an example, the shape of the engaged portions 48*c* and 48*f* is a rectangular shape. The surface 48*a* includes a recessed portion 48*d* that is a Y-axis direction end portion on the projecting portion 26 side and that is recessed in the Z-axis direction at a portion including the X-axis direction center. The recessed portion 48*d* reaches over a portion of the first side surface 45*a* of the first side portion 45 described above.

The opening portion 48*b* is a portion for coupling a wafer 40 of another stack-type wire mount wafer connector 20 to the wafer 40. For example, the second base portion 48 includes a plurality of opening portions 48*b*. The plurality of opening portions 48*b* is disposed at one Y-axis direction end of the second base portion 48 and another Y-axis direction end of the second base portion 48. For example, in at least one of Y-axis direction end portions of the second base portion 48 (as an example, an end portion on the projecting portion 26 side), the opening portions 48*b* are disposed at the one X-axis direction end of the second base portion 48 and the other X-axis direction end of the second base portion 48.

In the present embodiment, in a Y-axis direction end portion on the projecting portion 26 side, the opening portions 48*b* are disposed at each X-axis direction end portion. In a Y-axis direction end portion on the latch portion 25 side, the opening portion 48*b* is disposed at an X-axis direction end portion on the second end portion 44 side. For example, the opening portion 48*b* is formed into a rectangular shape including long sides in the X-axis direction and short sides in the Y-axis direction, and includes inner side surfaces 48*e* on which the outer peripheral surface 47*c* of the protrusion 47*b* is to come into abutment. For example, a pair of inner side surfaces 48*e* is provided in a width direction (Y-axis direction) of the opening portion 48*b*.

The width of the opening portion 48*b* (an interval between the pair of inner side surfaces 48*e*) is substantially the same as the diameter of the outer peripheral surface 47*c* of the protrusion 47*b*. Thus, when the protrusion 47*b* is pressed into the opening portion 48*b*, the outer peripheral surface 47*c* comes into abutment on each inner side surface 48*e* of the opening portion 48*b*, and the protrusion 47*b* is thereby coupled to the opening portion 48*b*. For example, two protrusions 47*b* forming the pair C are inserted into one opening portion 48*b*, and the outer peripheral surface 47*c* of each of the two protrusions 47*b* comes into abutment on each of the pair of inner side surfaces 48*e*. The one opening portion 48*b* provided for the plurality of protrusions 47*b*, as described above, can contribute to reducing the number of opening portions 48*b*. Note that the number, the size, the shape, and the manner of disposition of the protrusions 47*b* and the opening portions 48*b* are not limited to the examples described above, and can be changed, as appropriate.

Figure 8:
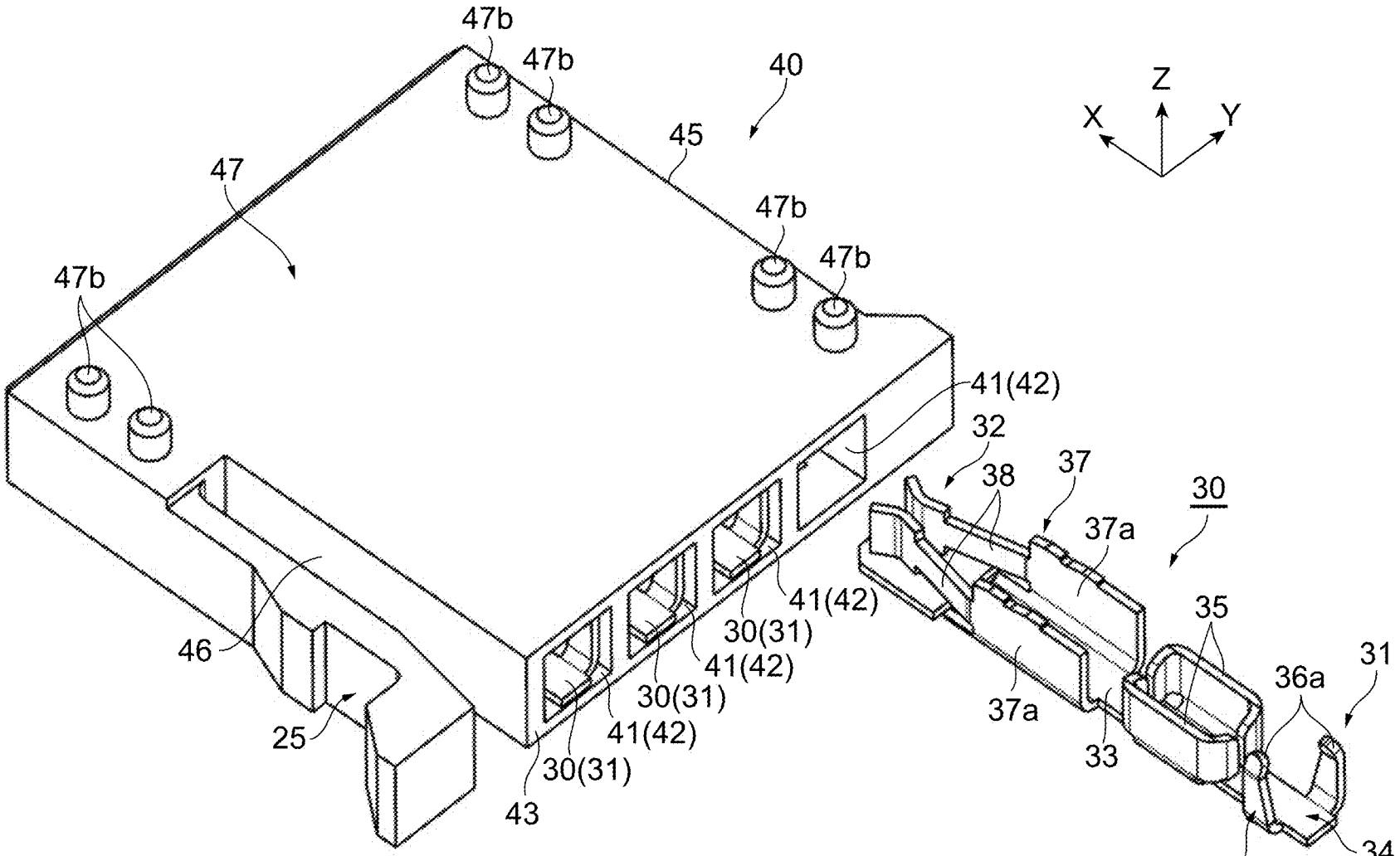
FIG. 8 is a perspective view illustrating an example of the second connector of FIG. 5 and a terminal.
Figure 9:
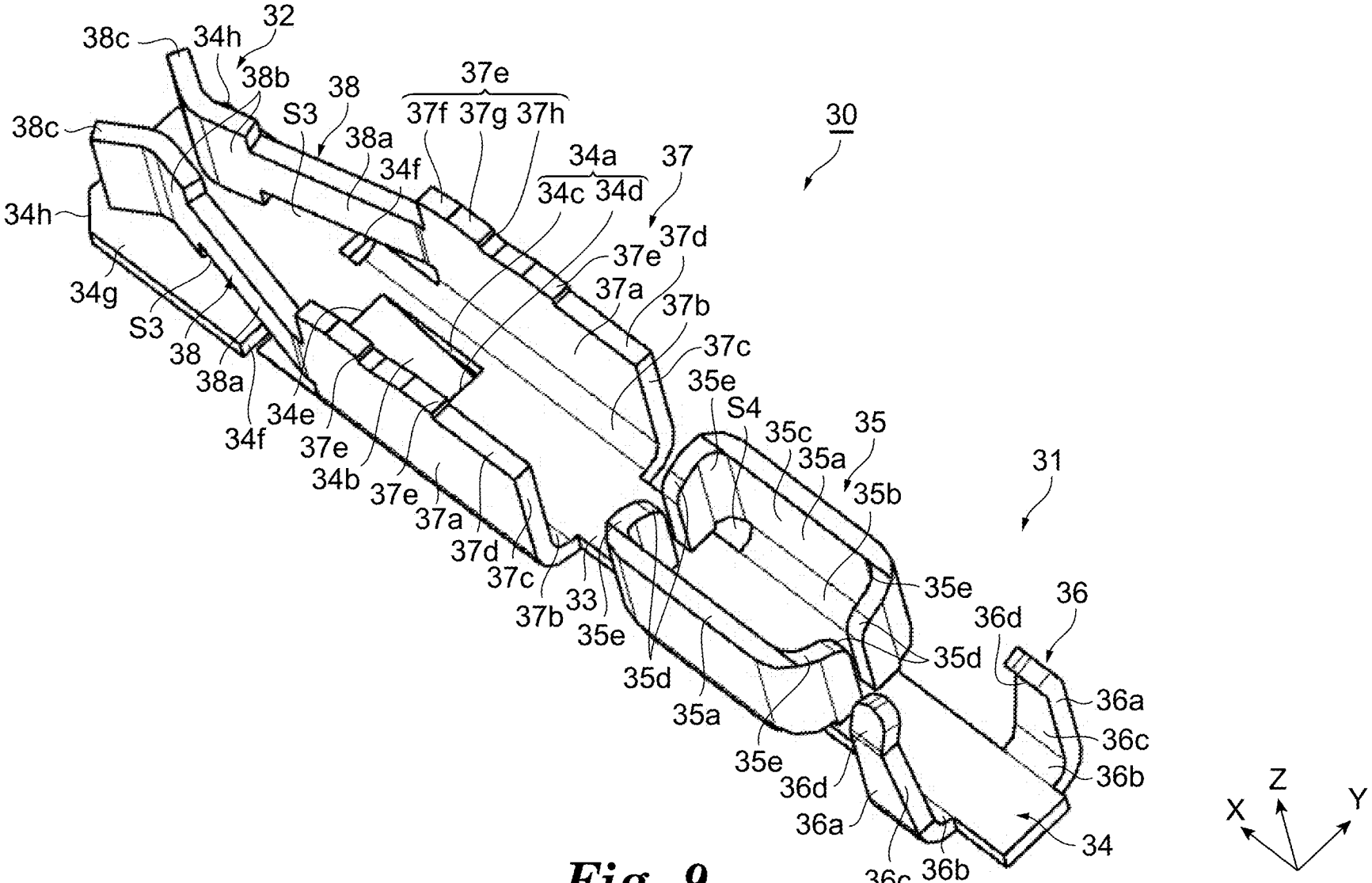
FIG. 9 is a perspective view illustrating the terminal of FIG. 8.
Figure 10:
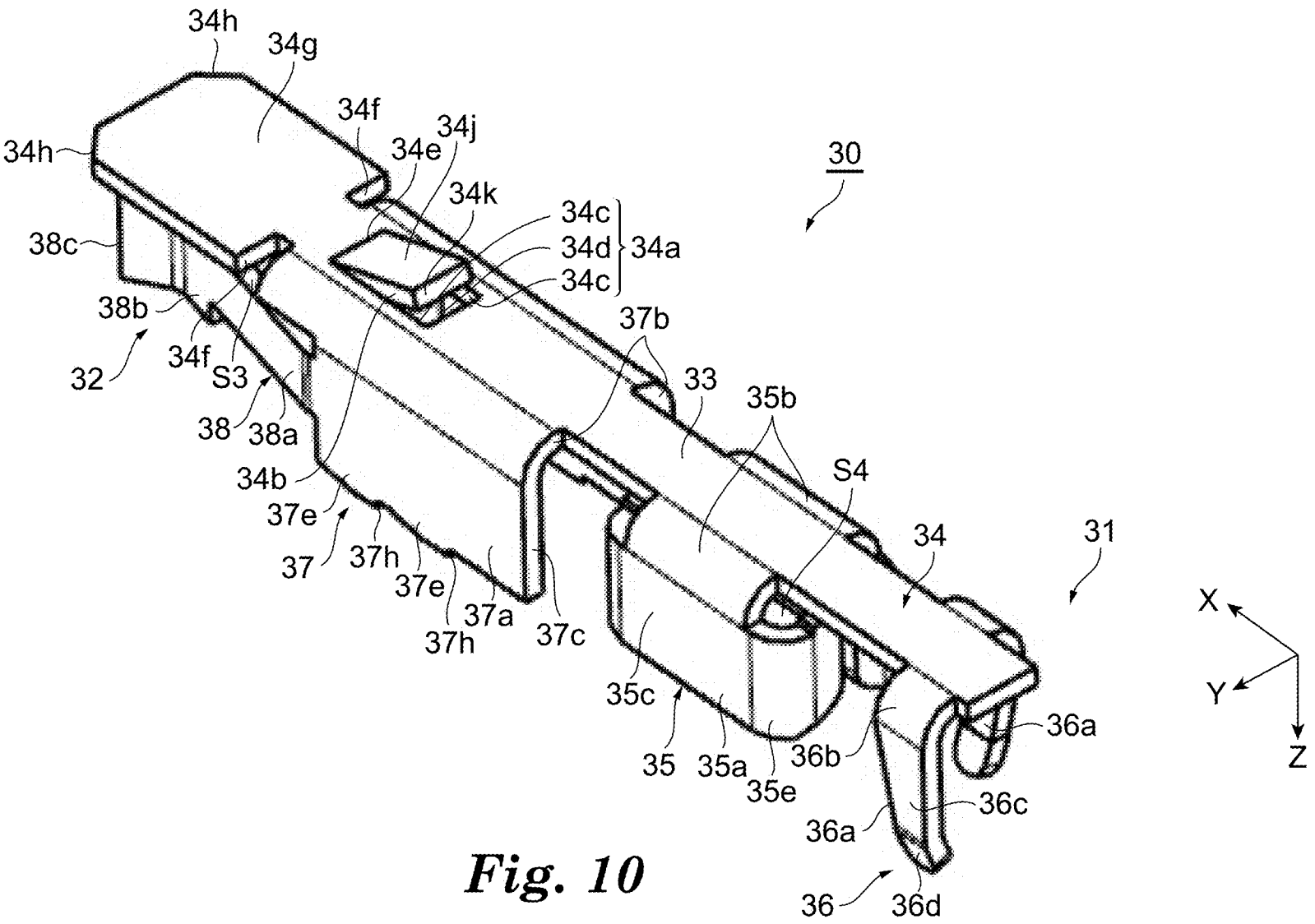
FIG. 10 is a perspective view of the terminal of FIG. 9, as seen in a direction different from that of FIG. 9.

Next, the terminal 30 to be accommodated in the cavity 41 of the wafer 40 will be described. FIG. 8 is a perspective view illustrating the terminal 30 to be inserted into one of the cavities 41. FIG. 9 is a perspective view illustrating the terminal 30. FIG. 10 is a perspective view of the terminal 30, as seen in a direction different from that of FIG. 9. As illustrated in FIG. 8, FIG. 9, and FIG. 10, the plurality of terminals 30 to be aligned to be spaced apart from each other is accommodated inside the cavities 41. Each terminal 30 includes a wire connecting portion 31 to be disposed at a position adjacent to the first end portion 43, the fitting portion 32 to be disposed at a position adjacent to the second end portion 44, and a connecting portion 33 connecting the wire connecting portion 31 and the fitting portion 32 to each other.

The terminal 30 includes a base portion 34 extending both in the X-axis direction and the Y-axis direction, and a pressing portion 35 extending upward with respect to the base portion 34. The base portion 34 is a plate-like portion extending in the X-axis direction. The wire connecting portion 31 is provided at one end of the base portion 34, and the fitting portion 32 is provided at another end of the base portion 34. The wire connecting portion 31 includes the pressing portion 35 and a first support portion 36. The first support portion 36 supports the wire 50, and the pressing portion 35 electrically connects the wire 50 to the terminal 30.

The fitting portion 32 includes a second support portion 37 and contact arm portions 38. For example, the fitting portion 32 includes the contact arm portions 38 that face each other and have flexibility. When the fitting portion 32 receives the contact 11 of the fitting connector 10, the contact 11 is received between a pair of contact arm portions 38 being pressed and opened (see FIG. 3). The second support portion 37 is provided at the contact arm portions 38 on the wire connecting portion 31 side, and the second support portion 37 includes a pair of second arm portions 37*a* extending upward with respect to the base portion 34 and facing each other.

The base portion 34 connects end portions of the pair of second arm portions 37*a*. A cutout 34*a* and an engaging portion 34*b* that projects from the cutout 34*a* are formed at a portion between the base portion 34 and the pair of second arm portions 37*a*. The engaging portion 34*b* is a portion to be engaged with the engaged portions 48*c*, 48*f* that are through holes of the wafer 40. When the engaging portion 34*b* is engaged with the engaged portion 48*c* or 48*f*, the terminal 30 is engaged with the wafer 40.

The cutout 34*a* is formed by a pair of first slits 34*c* extending in the X-axis direction and a second slit 34*d* extending in the Y-axis direction between end portions of the pair of first slits 34*c* on the wire connecting portion 31 side. The engaging portion 34*b* is a plate-like portion surrounded by the pair of first slits 34*c* and the second slit 34*d*. The engaging portion 34*b* includes an oscillation center portion 34*e* extending in the Y-axis direction at end portions of the pair of first slits 34*c* on the fitting portion 32 side, and can oscillate in the Z-axis direction about the oscillation center portion 34*e*. In a state in which no external force is applied, the engaging portion 34*b* extends at an angle from the oscillation center portion 34*e*. When the plate-like engaging portion 34*b* is fitted into the engaged portions 48*c*, 48*f* that are through holes, the engaging portion 34*b* is engaged with the engaged portions 48*c*, 48*f*.

A pair of recessed portions 34*f* recessed in a width direction (Y-axis direction) of the base portion 34 and a plate-like portion 34*g* extending in the X-axis direction and the Y-axis direction at the recessed portions 34*f* on the side of their X-axis direction end portions are formed in the base portion 34 on the side of an X-axis direction end portion of the engaging portion 34*b*. The plate-like portion 34*g* is formed into a substantially rectangular shape. The plate-like portion 34*g* includes a pair of inclined portions 34*h* extending at an angle with respect to both the X-axis direction and the Y-axis direction, at corner portions located on the side opposite to the recessed portions 34*f*.

The first support portion 36 includes a pair of first arm portions 36*a* that receives the wire 50 extending in the X-axis direction, and the pair of first arm portions 36*a* extends upward with respect to the base portion 34 and face each other. For example, X-axis direction positions of the pair of first arm portions 36*a* are shifted from each other. Specifically, one of the pair of first arm portions 36*a* (for example, the right first arm portion 36*a* in FIG. 9) is located closer to an X-axis direction end portion than the other (for example, the left first arm portion 36*a* in FIG. 9).

Each first arm portion 36*a* includes a curved portion 36*b* curved upward from a width direction end portion of the base portion 34, a plate-like portion 36*c* extending upward at an angle from the curved portion 36*b* on the side opposite to the base portion 34, and a tip end portion 36*d* inclined from an end portion of the plate-like portion 36*c* on the side opposite to the curved portion 36*b* toward the width direction inners side of the base portion 34. For example, the plate-like portion 36*c* is formed into a rectangular plate-like shape extending upward with respect to the base portion 34, and the width of the plate-like portion 36*c* is gradually reduced from the curved portion 36*b* to the tip end portion 36*d*. When the wire 50 is accommodated between a pair of plate-like portions 36*c* and a pair of tip end portions 36*d* aligning in the width direction of the base portion 34, the wire 50 is supported by the first support portion 36.

Each second arm portion 37*a* of the second support portion 37 includes a curved portion 37*b* curved upward from an end portion of the base portion 34 in the width direction, and a plate-like portion 37*c* extending upward from the curved portion 37*b* on the side opposite to the base portion 34. An end surface 37*d*, which is a side of the plate-like portion 37*c* opposite to the curved portion 37*b*, includes two step portions 37*e* aligning in a longitudinal direction (X-axis direction) of the base portion 34. Each step portion 37*e* includes an inclined surface 37*f* inclined upward at an angle from an end portion of the end surface 37*d* on the contact arm portion 38 side, a top surface 37*g* extending in the longitudinal direction of the base portion 34 from an upper end of the inclined surface 37*f*, and a step surface 37*h* extending downward from an end portion of the top surface 37*g* on the side opposite to the inclined surface 37*f*.

The contact arm portions 38 extend and project from each second support portion 37 toward the side of an X-axis direction end portion of the terminal 30. Spaces S3 extending in the width direction of the base portion 34 are formed between the contact arm portions 38 and the base portion 34. The contact arm portion 38 includes a first plate-like portion 38*a* extending and projecting from the second support portion 37 toward an X-axis direction end portion side and also extending to be inclined toward the width direction inner side of the base portion 34, a second plate-like portion 38*b* located at an end portion of the first plate-like portion 38*a* on the side opposite to the second support portion 37, and a third plate-like portion 38*c* inclined from an end portion of the second plate-like portion 38*b* on the side opposite to the first plate-like portion 38*a* toward the width direction outer side of the base portion 34.

The width of the first plate-like portion 38*a* is smaller than the width of the second support portion 37 and the width of the second plate-like portion 38*b*, and the width of the space S3 between the first plate-like portion 38*a* and the base portion 34 is larger than the width of the space S3 between the second plate-like portion 38*b* and the base portion 34. The first plate-like portion 38*a* and the second plate-like portion 38*b* are inclined further toward the width direction inner side of the base portion 34 the closer they are to the side of the X-axis direction end portions. The third plate-like portion 38*c* is inclined further toward the width direction outer side of the base portion 34 the closer it is to the side of the X-axis direction end portion. Thus, the contact 11 to be inserted into the contact arm portions 38 enters between a pair of third plate-like portions 38*c*, presses and opens the pair of third plate-like portions 38*c* and the pair of second plate-like portions 38*b* toward the width direction outer side of the base portion 34, and is thereby accommodated between the pair of first plate-like portions 38*a* and between the pair of second arm portions 37*a*.

Figure 11:
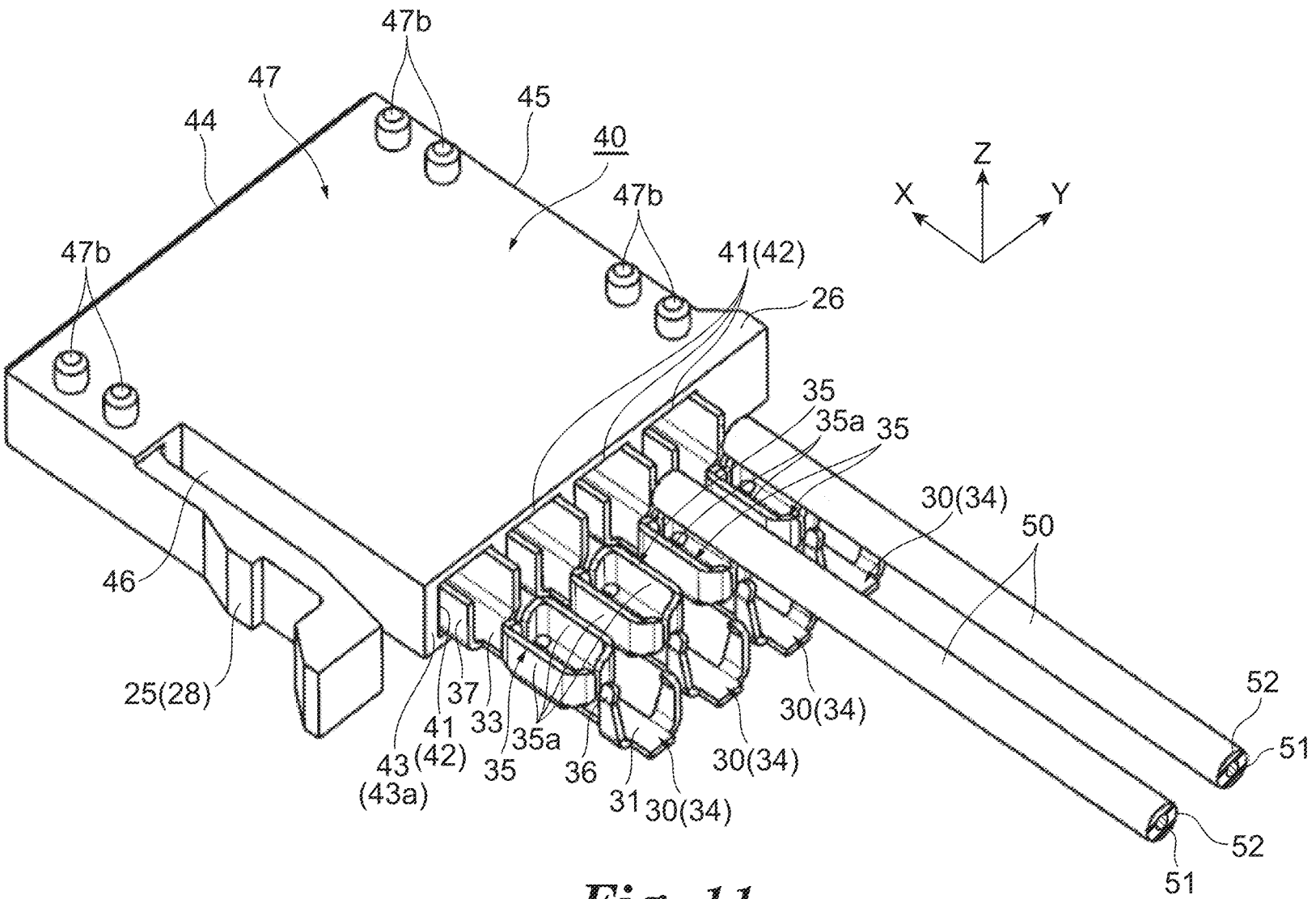
FIG. 11 is a perspective view illustrating an example of a state in which wires are mounted in the wafer of FIG. 7.

The pressing portion 35 is a portion to electrically connect the wire 50 to the terminal 30. FIG. 11 is a perspective view illustrating a state before an exemplary wires 50 are accommodated in the terminals 30. As illustrated in FIG. 9, FIG. 10, and FIG. 11, for example, each wire 50 is an insulated wire including a conductive portion 51, and an insulation layer 52 covering the conductive portion 51. The pressing portion 35 is a portion to enter the insulation layer 52 of the inserted wire 50 so as to be electrically connected to the conductive portion 51.

For example, the pressing portion 35 includes a pair of conductive arm portions 35*a* to be physically and electrically connected to the conductive portion 51 of the wire 50, and the pair of conductive arm portions 35*a* face each other in the width direction of the base portion 34. Each conductive arm portion 35*a* includes a curved portion 35*b* curved upward from a width direction end portion of the base portion 34, a plate-like portion 35*c* extending upward from the curved portion 35*b* on the side opposite to the base portion 34, and blade portions 35*d* that extends and projects from the plate-like portion 35*c* in the longitudinal direction of the base portion 34 and is curved toward the width direction inner side of the base portion 34. The blade portions 35*d* extend and project from one X-axis direction end and another X-axis direction end of the plate-like portion 35*c* toward the width direction inner side of the base portion 34, and the interval of the pair of blade portions 35*d* aligning in the width direction of the base portion 34 is smaller than the interval of the pair of plate-like portions 35*c*. A space S4 is formed between each blade portion 35*d* and the base portion 34.

Curved portions 35*e* are formed between each of the pair of blade portions 35*d* and the plate-like portion 35*c*. The shape of the pressing portion 35 as seen in an out-of-plane direction (Z-axis direction) of the base portion 34 is formed into a U-like shape in which the pair of blade portions 35*d* and the plate-like portion 35*c* are aligned, and a pair of such U-like portions is aligned in the width direction of the base portion 34. The pair of U-like portions of the pressing portion 35 face each other. When the wire 50 is pressed into the U-like portions of the pressing portion 35, each blade portion 35*d* cuts the insulation layer 52 of the wire 50 to enter the insulation layer 52, and each blade portion 35*d* comes in contact with the conductive portion 51 of the wire 50. In this manner, the wire 50 is firmly retained by the terminal 30, and is also electrically connected to the terminal 30.

Next, a method of assembling the connector assembly 1 and the stack-type wire mount wafer connector 20 will be described. The wire 50 retained as described above is accommodated in the channel 42 of each cavity 41 of the wafer 40, together with the terminal 30. When the terminal 30 is pressed into each channel 42 in the X-axis direction, as illustrated in FIG. 7 and FIG. 10, a back surface 34*j* of the engaging portion 34*b* of the terminal 30 moves toward the second end portion 44 side along an inner wall of the cavity 41, and then a tip end surface 34*k* of the engaging portion 34*b* is caught on an inner wall 48*g* of the engaged portion 48*c*. In this manner, the engaging portion 34*b* is engaged with the engaged portion 48*c*, and the terminal 30 is thereby engaged with the wafer 40. In this state, when an external force acting in a direction of removing from the wafer 40 to the terminal 30 is applied, the tip end surface 34*k* of the engaging portion 34*b* is caught on the inner wall 48*g* of the engaged portion 48*c*, and the step surface 37*h* of each step portion 37*e* of the second support portion 37 is caught on an inner wall defining the cavity 41. In this manner, the terminal 30 is provided to resist being removed to the outside of the cavity 41.

After the terminal 30 is accommodated in each channel 42 of the wafer 40 as described above, assembly of the stack-type wire mount wafer connector 20 is completed. Subsequently, the stack-type wire mount wafer connector 20 is accommodated in the fitting connector 10 to assemble the connector assembly 1. The stack-type wire mount wafer connector 20 can be fitted into the fitting connector 10 alone, or the plurality of stack-type wire mount wafer connectors 20 can be fitted into the fitting connector 10 in a state in which the plurality of stack-type wire mount wafer connectors 20 are stacked on each other.

When the plurality of stack-type wire mount wafer connectors 20 is assembled, in the stack-type wire mount wafer connectors 20 in a state illustrated in FIG. 6 and FIG. 7, for example, the position of each protrusion 47*b* is adjusted to the position of each opening portion 48*b*, and, into each opening portion 48*b* of one stack-type wire mount wafer connector 20, each protrusion 47*b* of another stack-type wire mount wafer connector 20 is inserted. In this manner, slippage between the one stack-type wire mount wafer connector 20 and the other stack-type wire mount wafer connector 20 in the X-axis direction can be prevented. The one stack-type wire mount wafer connector 20 and the other stack-type wire mount wafer connector 20 are firmly coupled in the Z-axis direction, and slippage in the Y-axis direction can be prevented.

Subsequently, as illustrating in FIG. 1, FIG. 2, and FIG. 3, for example, a single or a plurality of stack-type wire mount wafer connectors 20 are fitted into the fitting connector 10. As an example, the plurality of fitting connectors 10 are fixed to the board B in the Z-axis direction in advance, and the stack-type wire mount wafer connector(s) 20 is inserted into and removed from each fitting connector 10. The number of stack-type wire mount wafer connectors 20 to be fitted into one fitting connector 10 can be changed, as appropriate, on the condition that the number is equal to or less than the number of connectors that can be accommodated in the fitting connector 10 (four in the present embodiment).

When the stack-type wire mount wafer connector 20 is set down into the fitting connector 10 in the X-axis direction, the second end portion 44 of the wafer 40 and the bottom portion 18 of the fitting connector 10 come closer to each other, thereby bringing the contact 11 to be fitted into the hole portion 44*b* of the second end portion 44. The contact 11 presses and opens the contact arm portions 38 of the terminal 30, and is fitted into the fitting portion 32 of the terminal 30. In this state, the contact 11 is retained owing to spring characteristics of the pair of contact arm portions 38 sandwiching the contact 11.

When the stack-type wire mount wafer connector 20 is set down in the X-axis direction, the latch portion 25 of the stack-type wire mount wafer connector 20 on the Z-axis direction center side of the fitting connector 10 is engaged with the hole portion 10*d*. Specifically, when the stack-type wire mount wafer connector 20 is set down, the tapered surface 28*a* and the top surface 28*b* slide and move downward along the inner surface 10*f* of the fitting connector 10, and the latch portion 25 (the pressed portion 29, the engaging portion 28, and the base portion 27) is bent toward the second side portion 46. After that, the tapered surface 28*a* and the top surface 28*b* are exposed from the hole portion 10*d*. In this manner, the latch portion 25 is engaged with the hole portion 10*d*. Note that the stack-type wire mount wafer connector 20 located on the side of a Z-axis direction end portion of the fitting connector 10 is not engaged with the fitting connector 10. In this case, the latch portion 25 (the pressed portion 29, the engaging portion 28, and the base portion 27) of the stack-type wire mount wafer connector 20 is bent toward the second side portion 46, and the stack-type wire mount wafer connector 20 is sandwiched between the stack-type wire mount wafer connector 20 on the Z-axis direction center side and an inner wall of the fitting connector 10.

When the latch portion(s) 25 of a single or a plurality of stack-type wire mount wafer connectors 20 are engaged with the hole portion 10*d* of the fitting connector 10 as described above, the stack-type wire mount wafer connector(s) 20 is fitted into the fitting connector 10. Note that the height of the stack-type wire mount wafer connector 20 fitted into the fitting connector 10 is lower than the height of the fitting connector 10 (for example, the upper end 15*a*, the upper end 16*a*, and the upper end 17*a*). Since the height of the connector assembly 1 as a whole is reduced, the size is made compact.

When the stack-type wire mount wafer connector 20 is removed from the fitting connector 10, for example, a fitting connector 10 into which a target stack-type wire mount wafer connector 20 to be removed is fitted is manually searched for among a plurality of fitting connectors 10 fixed to the board B, and the target stack-type wire mount wafer connector 20 is removed from the fitting connector 10 manually searched. In this case, since the fitting connector 10 according to the present embodiment includes the projecting portion 19 located below the latch portion 25 (hole portion 10*d*), the target stack-type wire mount wafer connector 20 can be easily found by manually searching for the projecting portion 19. In other words, by manually searching for and recognizing the projecting portion 19, the position of the connector assembly 1 on the board B can be easily recognized, and the target stack-type wire mount wafer connector 20 can be easily found.

After the target stack-type wire mount wafer connector 20 is found, the pressed portion 29 of the latch portion 25 of the target stack-type wire mount wafer connector 20 is pressed toward the second side portion 46, whereby the base portion 27 is bent and brought to an unlatched state. In other words, a state changes from a latched state in which the stack-type wire mount wafer connector 20 is engaged with the fitting connector 10 to an unlatched state in which the stack-type wire mount wafer connector 20 is unlatched from the fitting connector 10. After changing to the unlatched state, the latch portion 25 of the stack-type wire mount wafer connector 20 is no longer engaged with the hole portion 10*d* of the fitting connector 10, and thus the stack-type wire mount wafer connector 20 can be easily removed (pulled up) from the fitting connector 10.

Next, effects of the stack-type wire mount wafer connector 20 and the connector assembly 1 according to the present embodiment will be described in detail. Each stack-type wire mount wafer connector 20 includes the stackable and electrically insulated wafer 40, which electrically connects the plurality of wires 50 and the fitting connector 10 to each other. As illustrated in FIG. 5, FIG. 7, and other figures, the wafer 40 is formed by the first end portion 43 including the first end surface 43*a*, the second end portion 44 including the second end surface 44*a*, the first side portion 45 including the first side surface 45*a*, and the second side portion 46 including the second side surface 46*a*. The wafer 40 receives the plurality of wires 50 on the first end surface 43*a* and is fitted into the fitting connector 10 on the second end surface 44*a*. The wafer 40 includes a latch portion 25 extending along the second side surface 46*a*, a protrusion 47*b* protruding from a first base portion 47, and an opening portion 48*b* into which the protrusion 47*b* of another stack-type wire mount wafer connector 20 is to be inserted. When the protrusion 47*b* of the other stack-type wire mount wafer connector 20 is inserted into the opening portion 48*b* of the one stack-type wire mount wafer connector 20, slippage in a fitting direction (X-axis direction) is prevented. Therefore, the plurality of stack-type wire mount wafer connectors 20 can be stacked in a state in which the plurality of stack-type wire mount wafer connectors 20 is coupled to each other.

Each of the plurality of stack-type wire mount wafer connectors 20 includes the latch portion 25, and each latch portion 25 is engaged with the fitting connector 10. Therefore, another component, such as a cover for uniting the plurality of stack-type wire mount wafer connectors 20, is not necessary. Thus, a stack-type wire mount wafer connector 20 can be inserted into and removed from the fitting connector 10 alone, or the plurality of stack-type wire mount wafer connectors 20 can be collectively inserted into and removed from the fitting connector 10. As a result, the number of components can be reduced, and operability of insertion into and removal from the fitting connector 10 can be enhanced.

The stack-type wire mount wafer connector 20 can be inserted into and removed from the fitting connector 10 alone. Therefore, the number of stack-type wire mount wafer connectors 20 can be easily adjusted according to wiring density of a device. In addition, another component such as a cover for uniting the plurality of stack-type wire mount wafer connectors 20 is not necessary. Therefore, an area for accommodating another component such as a cover need not be secured in the fitting connector 10. Thus, the connector assembly 1 including the fitting connector 10 and the stack-type wire mount wafer connector 20 can be downsized.

When the protrusion 47*b* of the other stack-type wire mount wafer connector 20 is inserted into the opening portion 48*b* of the stack-type wire mount wafer connector 20, slippage in the fitting direction (X-axis direction) may be prevented, and slippage in a horizontal direction (Y-axis) intersecting both the fitting direction and the thickness direction (Z-axis direction) may be prevented. In this case, slippage in three directions, which are the fitting direction, the thickness direction, and the horizontal direction, is prevented in a state in which the plurality of stack-type wire mount wafer connectors 20 are stacked. Therefore, engagement between the plurality of stack-type wire mount wafer connectors 20 can be firmly secured.

The stack-type wire mount wafer connector 20 may include the plurality of terminals 30 to be disposed inside the cavities 41 and aligned to be spaced apart from each other. As illustrated in FIG. 3, FIG. 7, and FIG. 11, each of the plurality of terminals 30 may include: the wire connecting portion 31 to be disposed at a position adjacent to the first end surface 43 to receive the wire 50 so as to come in contact with the wire 50, the fitting portion 32 that is to be disposed at a position adjacent to the second end surface 44*a* and into which a contact 11 extending from the fitting connector 10 is to be fitted, and the connecting portion 33 that connects the wire connecting portion 31 and the fitting portion 32 to each other.

In this case, the plurality of terminals 30 is provided in the cavities 41 inside the wafer 40 of the stack-type wire mount wafer connector 20. Each terminal 30 receives the wire 50 in the wire connecting portion 31 to be disposed at a position adjacent to the first end surface 43*a*, and the contact 11 extending from the fitting connector 10 is fitted into the fitting portion 32 to be disposed at a position adjacent to the second end surface 44*a*. Thus, since the wire connecting portion 31 and the fitting portion 32 are connected to each other with the connecting portion 33, the wire 50 and the contact 11 can be electrically connected to each other through the terminal 30.

When the terminal 30 receives the wire 50, at least a portion of the fitting portion 32 may be located inside the cavity 41, and at least a portion of the wire connecting portion 31 may be located outside the wafer 40. In a state in which the wire connecting portion 31 receives the wire 50 so as to come in contact with the wire 50, the terminal 30 may be inserted into the inside of the cavity 41 so that an engaging portion 34*b* of the terminal 30 is engaged with the engaged portion 48*c* of the wafer 40. In a state in which the engaging portion 34*b* is engaged with the engaged portion 48*c*, the terminal 30 may be provided to resist being removed to an outside of the cavity 41.

In this case, when the terminal 30 receives the wire 50, at least a portion of the wire connecting portion 31 is exposed to the outside of the wafer 40, and in this state, the wire 50 is connected to the wire connecting portion 31. Then, as illustrated in FIG. 7 and FIG. 10, when the terminal 30 is inserted into the inside of the cavity 41, the engaging portion 34*b* of the terminal 30 is engaged with the engaged portion 48*c* of the wafer 40. In a state in which the engaging portion 34*b* is engaged with the engaged portion 48*c*, resistance is generated when a removal force toward the outside of the cavity 41 acts on the terminal 30. Therefore, in a state in which the terminal 30 is inserted into the inside of the cavity 41 with the wire 50 being connected to the wire connecting portion 31 of the terminal 30, removal of the terminal 30 can be prevented even when a removal force toward the outside acts on the terminal 30. As a result, the terminal 30 to which the wire 50 is connected can be prevented from being removed toward the outside. Therefore, the terminal 30 and the wire 50 can be more securely connected to the fitting connector 10.

As illustrated in FIG. 11, the terminal 30 may include a base portion 34, and a pressing portion 35 extending upward with respect to the base portion 34. The pressing portion 35 may enter an insulation layer 52 of the wire 50 so as to be physically and electrically connected to a conductive portion 51 of the wire 50, and may thereby electrically come in contact with the conductive portion 51 of the wire 50 being insulated. In this case, when the terminal 30 receives the wire 50, the pressing portion 35 enters the insulation layer 52 of the wire 50, and thereby the terminal 30 and the conductive portion 51 electrically come in contact with each other. Therefore, by pressing the insulated wire 50 into the pressing portion 35 extending from the base portion 34, the pressing portion 35 can enter the insulation layer 52 and make electrical contact. Thus, the wire 50 can be easily disposed in the stack-type wire mount wafer connector 20 by inserting the wire 50.

As illustrated in FIG. 3, the fitting portion 32 of the terminal 30 may include a pair of contact arm portions 38 facing each other and having flexibility. When the fitting portion 32 receives the contact 11 of the fitting connector 10, the contact 11 may be accommodated between the pair of contact arm portions 38 being pressed and opened. In this case, the contact 11 extending from the fitting connector 10 presses and opens the pair of contact arm portions 38 of the terminal 30, and is received between the pair of contact arm portions 38. Therefore, the contact 11 extending from the fitting connector 10 is received between the pair of contact arm portions 38 having flexibility (spring characteristics), and thus the contact 11 can be retained in the stack-type wire mount wafer connector 20.

Each of the plurality of terminals 30 may further include the first support portion 36 and the second support portion 37. The first support portion 36 may include the pair of first arm portions 36 extending upward with respect to the base portion 34 of the terminal 30 and facing each other. The second support portion 37 may include the pair of second arm portions 37*a* extending upward with respect to the base portion 34 of the terminal 30 and facing each other. When the terminal 30 receives the wire 50 and the contact 11 of the fitting connector 10, a portion of the wire 50 may be located between the pair of first arm portions 36*a* of the first support portion 36, and a portion of the contact 11 may be located between the pair of second arm portions 37*a* of the second support portion 37. In this case, a portion of the wire 50 is located between the pair of first arm portions 36*a* of the terminal 30, and a portion of the contact 11 extending from the fitting connector 10 is located between the pair of second arm portions 37*a*. Therefore, both of the wire 50 and the contact 11 can be connected to the terminal 30.

The cavities 41 may be defined by the plurality of channels 42. Each of the plurality of channels 42 may extend in the fitting direction (X-axis direction) of the wafer 40, and may be configured to receive the plurality of terminals 30 to be aligned to be spaced apart from each other. In this case, each of the plurality of terminals 30 enters each of the plurality of channels 42 divided by the cavities 41 of the wafer 40. Therefore, the wire 50 can be disposed in each of the plurality of terminals 30 accommodated in one wafer 40.

As illustrated in FIG. 1, FIG. 2, and FIG. 3, the fitting connector 10 may be a board mount connector. In this case, each of the plurality of stack-type wire mount wafer connectors 20 can be easily inserted into and removed from the board mount connector.

In the connector assembly 1, a fitting connector 10 serving as a first connector includes an open end portion 12 and defines a receiving area 13 that receives stack-type wire mount wafer connectors 20 serving as the plurality of second connectors, and each of the plurality of stackable stack-type wire mount wafer connectors 20 is fitted into the fitting connector 10. Each of the plurality of stack-type wire mount wafer connectors 20 includes a latch portion 25 that changes to each of a latched and an engaged state with respect to the fitting connector 10, and an unlatched state with respect to the fitting connector 10. Therefore, when each stack-type wire mount wafer connector 20 includes the latch portion 25, another component such as a cover for uniting the plurality of stack-type wire mount wafer connectors 20 is unnecessary. Thus, each stack-type wire mount wafer connector 20 can be inserted into and removed from the fitting connector 10 alone, or the plurality of stack-type wire mount wafer connectors 20 can be collectively inserted into and removed from the fitting connector 10. Therefore, effects similar to those of the stack-type wire mount wafer connector 20 can be achieved from the connector assembly 1.

Except when the latch portion 25 of each of the stack-type wire mount wafer connectors 20 being stacked is in the unlatched state, or when all of the plurality of stack-type wire mount wafer connectors 20 are unfitted at the same time, none of the stack-type wire mount wafer connectors 20 of the plurality of stack-type wire mount wafer connectors 20 being stacked may not be unfitted from the fitting connector 10.

In this case, except the unlatched state, or when all of the plurality of stack-type wire mount wafer connectors 20 are unfitted at the same time, unfitting from the fitting connector 10 is not carried out. Therefore, the stack-type wire mount wafer connector 20 can be prevented from being unintentionally unfitted from the fitting connector 10, and the plurality of stack-type wire mount wafer connectors 20 can be firmly fitted into the fitting connector 10.

The latch portions 25 of some of the stack-type wire mount wafer connectors 20 out of the plurality of stack-type wire mount wafer connectors 20 accommodated in the fitting connector 10 may be engaged with the fitting connector 10, while the latch portions 25 of the rest of the stack-type wire mount wafer connectors 20 may not be engaged with the fitting connector 10. In this case, engagement or disengagement of some of the latch portions 25 can cause all of the stack-type wire mount wafer connectors 20 to be fitted and unfitted. Thus, the stack-type wire mount wafer connectors 20 can be easily fitted into and unfitted from the fitting connector 10 (the latched state and the unlatched state can be easily changed).

The latch portions 25 of the stack-type wire mount wafer connectors 20 located on the Z-axis direction center side out of the plurality of stack-type wire mount wafer connectors 20 aligning in the Z-axis direction may be engaged with the fitting connector 10, while the latch portions 25 of the stack-type wire mount wafer connectors 20 located on both Z-axis direction end sides may not be engaged with the fitting connector 10. In this case, when the latch portions 25 located on the Z-axis direction center side are unlatched, all of the stack-type wire mount wafer connectors 20 can be removed from the fitting connector 10. Thus, the plurality of stack-type wire mount wafer connectors 20 can be easily removed from the fitting connector 10.

As illustrated in FIG. 1, in a state in which the plurality of fitting connectors 10 are arrayed, only the latch portions 25 of the stack-type wire mount wafer connectors 20 located on the Z-axis direction center side may be engaged with the fitting connector 10. In this case, the distance between the latch portions 25 aligning between the plurality of fitting connectors 10 can be increased. Thus, the stack-type wire mount wafer connectors 20 of any adjacent fitting connector 10 can be less liable to be removed by mistake.

The fitting connector 10 may include the projecting portion 19 located at a position adjacent to (for example, below) the latch portion 25. In this case, when a target stack-type wire mount wafer connector 20 to be removed is manually searched for with the connector assembly 1 being unable to be directly visually recognized, the projecting portion 19 can be used as a reference point for the latch portion 25 of the target stack-type wire mount wafer connector 20 to be removed. Therefore, the position of the latch portion 25 of the target stack-type wire mount wafer connector 20 can be easily known by touching the projecting portion 19 of the corresponding fitting connector 10. Thus, the stack-type wire mount wafer connector 20 can be removed from the fitting connector 10 even more easily.

The embodiment of the present disclosure has been described above, but the present disclosure is not limited to the embodiment described above. For example, the shape, the size, the number, the material, and the manner of disposition of each part of the stack-type wire mount wafer connector and the connector assembly according to the present disclosure are not limited to those of the embodiment described above, and can be changed, as appropriate. For example, the shape, the size, the number, the material, and the manner of disposition of each of the fitting connector 10, the stack-type wire mount wafer connector 20, the terminal 30, the wafer 40, and the wire 50 are not limited to those of the embodiment described above, and can be changed, as appropriate.

For example, the embodiment described above describes an example in which the latch portions 25 of two stack-type wire mount wafer connectors 20 of four stack-type wire mount wafer connectors 20 are engaged with the hole portion 10*d* of the fitting connector 10. However, the number of latch portions to be engaged with the hole portion 10*d* of the fitting connector 10 is not limited to two, and may be one, or three or more. In addition, the number of stack-type wire mount wafer connectors to be accommodated in one fitting connector is not limited to four, and may be two, three, or five or more.

The embodiment described above describes an example in which the fitting connector 10 of the connector assembly 1 is a board mount connector. However, the fitting connector (first connector) according to the present disclosure may be a connector other than the board mount connector, and may be a relay connector that connects one electrical connector and another electrical connector to each other, for example.

REFERENCE SIGNS LIST

1 Connector assembly
10 Fitting connector (first connector)
11 Contact
12 Open end portion
13 Receiving area
14, 45 First side portion
15, 46 Second side portion
20 Stack-type wire mount wafer connector (second connector)
25 Latch portion
28, 34*b* Engaging portion
30 Terminal
31 Wire connecting portion
32 Fitting portion
33 Connecting portion
34 Base portion
35 Pressing portion
36 First support portion
36*a* First arm portion
37 Second support portion
37*a* Second arm portion
38 Contact arm portion
40 Wafer
41 Cavity
42 Channel
43 First end portion
43*a* First end surface
44 Second end portion
44*a* Second end surface
45 First side portion
45*a* First side surface
46 Second side portion
46*a* Second side surface
47 First base portion
47*b* Protrusion
48 Second base portion
48*b* Opening portion
48*c* Engaged portion
50 Wire
51 Conductive portion
52 Insulation layer.

The invention claimed is:

1. A stack-type wire mount wafer connector for fitting along a fitting direction, and electrically connecting a plurality of wires, to a fitting connector and including a wafer that is stackable and electrically insulated, the stack-type wire mount wafer connector comprising:

a first base portion and a second base portion extending between a first side portion and a second side portion facing each other and extending between a first end portion and a second end portion facing each other, the first base portion and the second base portion defining cavities between the first base portion and the second base portion;

a first end surface provided at the first end portion, the first end surface being configured to receive the plurality of wires;

a second end surface provided at the second end portion, the second end surface being configured to be fitted to the fitting connector;

a first side surface provided at the first side portion;

a second side surface provided at the second side portion;

a latch portion being integrally formed with the wafer, and extending along the second side surface of the wafer;

at least one protrusion extending outward along a thickness direction (Z-axis) of the wafer from the first base portion of the wafer; and at least one opening portion into which at least one protrusion of another stack-type wire mount wafer connector is to be inserted; wherein when the at least one protrusion of the another stack-type wire mount wafer connector is inserted into the at least one opening portion of the stack-type wire mount wafer connector to form a stacked connectors, slippage between the stack-type wire mount wafer connector and the another stack-type wire mount wafer connector in the fitting direction (X-axis) of the fitting connector is prevented, so that when the stacked connectors is fitted to the fitting connector and the latch portion of each of the stack-type wire mount wafer connectors is in latched state, then neither of the stack-type wire mount wafer connectors can be unfitted from the fitting connector unless both of the latch portions are put in unlatched state.

2. The stack-type wire mount wafer connector according to claim 1, wherein the at least one protrusion of the another stack-type wire mount wafer connector is inserted into the at least one opening portion of the stack-type wire mount wafer connector, thereby preventing slippage in the fitting direction as well as slippage in a horizontal direction (Y-axis) intersecting both the fitting direction and the thickness direction.

3. The stack-type wire mount wafer connector according to claim 1, further comprising a plurality of terminals disposed inside the cavities and aligned to be spaced apart from each other, wherein each of the plurality of terminals includes:

a wire connecting portion disposed at a position adjacent to the first end surface, the wire connecting portion being configured to receive one of the plurality of wires to come in contact with the one of the plurality of wires;

a fitting portion to be disposed at a position adjacent to the second end surface, into which a contact extending from the fitting connector is to be fitted; and a connecting portion connecting the wire connecting portion and the fitting portion to each other.

4. The stack-type wire mount wafer connector according to claim 3, wherein:

when one of the plurality of terminals receives one of the plurality of wires, at least a portion of the fitting portion is located inside one of the cavities, and at least a portion of the wire connecting portion is located outside the wafer;

in a state in which the wire connecting portion receives one of the plurality of wires to come in contact with the one of the plurality of wires, one of the plurality of terminals is inserted into an inside of one of the cavities to engage an engaging portion of the one of the plurality of terminals with an engaged portion of the wafer; and in a state in which the engaging portion is engaged with the engaged portion, the one of the plurality of terminals is provided to resist being removed to an outside of the one of the cavities.

5. The stack-type wire mount wafer connector according to claim 3, wherein each of the plurality of terminals includes a base portion, and a pressing portion extending upward with respect to the base portion; and the pressing portion enters an insulation layer of one of the plurality of wires to be physically and electrically connected to a conductive portion of the one of the plurality of wires, and thereby electrically comes in contact with the conductive portion of the one of the plurality of insulated wires.

6. The stack-type wire mount wafer connector according to claim 3, wherein:

the fitting portion of each of the plurality of terminals includes a pair of contact arm portions facing each other and having flexibility; and when the fitting portion receives the contact of the fitting connector, the contact is received between the pair of contact arm portions being pressed and opened.

7. The stack-type wire mount wafer connector according to claim 3, wherein:

each of the plurality of terminals further includes a first support portion and a second support portion;

the first support portion includes a pair of first arm portions extending upward with respect to a base portion of each of the plurality of terminals and facing each other;

the second support portion includes a pair of second arm portions extending upward with respect to the base portion of each of the plurality of terminals and facing each other; and when one of the plurality of terminals receives one of the plurality of wires and the contact of the fitting connector, a portion of the one of the plurality of wires is located between the pair of first arms of the first support portion, and a portion of the contact is located between the pair of second arms of the second support portion.

8. The stack-type wire mount wafer connector according to claim 3, wherein:

the cavities are defined by a plurality of channels; and each of the plurality of channels extends along the fitting direction of the wafer, and is configured to receive each of the plurality of the terminals to be aligned to be spaced apart from each other.

9. The stack-type wire mount wafer connector according to claim 1, wherein the fitting connector is a board mount connector.

* * * * *